US007160286B2

(12) United States Patent
Lammer

(10) Patent No.: US 7,160,286 B2
(45) **Date of Patent: *Jan. 9, 2007**

(54) RACKET WITH SELF-POWERED PIEZOELECTRIC DAMPING SYSTEM

(75) Inventor: Herfried Lammer, Lauterach (AT)

(73) Assignee: Head Sport AG, Kennelbach (AT)

( * ) Notice: Subject to any disclaimer, the term of this patent is extended or adjusted under 35 U.S.C. 154(b) by 0 days.

This patent is subject to a terminal disclaimer.

(21) Appl. No.: 11/238,075

(22) Filed: Sep. 27, 2005

(65) Prior Publication Data

US 2006/0079354 A1 Apr. 13, 2006

Related U.S. Application Data

(63) Continuation of application No. 09/918,437, filed on Aug. 1, 2001, now Pat. No. 6,974,397.

(30) Foreign Application Priority Data

Aug. 1, 2000 (EP) ..... 00116596

(51) Int. Cl.
*A61B 17/00* (2006.01)

(52) U.S. Cl. ..... 606/1; 473/521; 473/523; 473/546

(58) Field of Classification Search ..... 606/1; 473/520, 521, 523, 524, 546
See application file for complete search history.

(56) References Cited

U.S. PATENT DOCUMENTS

| | | | |
|---|---|---|---|
| 3,582,691 | A | 6/1971 | Sonderegger et al. |
| 4,402,524 | A | 9/1983 | D'Antonio et al. |
| 4,706,985 | A | 11/1987 | Meatto |
| 5,499,836 | A | 3/1996 | Juhasz |
| 5,590,908 | A | 1/1997 | Carr |
| 5,615,905 | A | 4/1997 | Stepanek et al. |
| 5,656,882 | A | 8/1997 | Lazarus et al. |
| 5,687,462 | A | 11/1997 | Lazarus et al. |
| 5,775,715 | A | 7/1998 | Vandergrift |
| 5,779,257 | A | 7/1998 | Bonvallet et al. |
| D404,100 | S | 1/1999 | Lazarus et al. |
| 5,857,694 | A | 1/1999 | Lazarus et al. |
| 5,869,189 | A | 2/1999 | Hagood, IV et al. |
| 6,048,622 | A | 4/2000 | Hagood, IV et al. |
| 6,069,433 | A | 5/2000 | Lazarus et al. |
| 6,086,490 | A | 7/2000 | Spangler et al. |
| 6,095,547 | A | 8/2000 | Vandergrift et al. |
| 6,102,426 | A | 8/2000 | Lazarus et al. |
| 6,196,935 | B1 | 3/2001 | Spangler et al. |
| 2004/0152544 | A1 | 8/2004 | Lammer |

FOREIGN PATENT DOCUMENTS

| | | |
|---|---|---|
| DE | 25 02 031 | 7/1976 |
| DE | 41 05 759 A1 | 8/1992 |
| DE | 197 44 344 C1 | 4/1999 |
| EP | 0 162 372 A2 | 11/1985 |

(Continued)

*Primary Examiner*—Rosiland Rollins
(74) *Attorney, Agent, or Firm*—Finnegan, Henderson, Farabow, Garrett & Dunner LLP

(57) ABSTRACT

According to one embodiment of the invention, a sports racket includes a racket frame comprising a head portion, handle portion and a throat portion joining the head portion to the handle portion. The racket frame also comprises a self-powered piezoelectric damping system for damping vibrations of the racket during play. The self-powered piezoelectric damping system comprises at least one transducer laminated to the racket and at least one circuit located within the racket handle portion and electrically connected to the at least one transducer.

20 Claims, 21 Drawing Sheets

FOREIGN PATENT DOCUMENTS

| | | | |
|---|---|---|---|
| EP | 0 841 969 | B1 | 5/1998 |
| EP | 0 963 768 | A1 | 12/1999 |
| EP | 0 970 727 | A1 | 1/2000 |
| EP | 1 080 746 | A1 | 3/2001 |
| FR | 2 643 430 | | 8/1990 |
| FR | 2 741 274 | | 5/1997 |
| SE | 465 603 | | 10/1991 |
| WO | WO 95/20827 | | 8/1995 |
| WO | WO 97/04841 | | 2/1997 |
| WO | WO 97/11756 | | 4/1997 |
| WO | WO 98/34689 | | 8/1998 |
| WO | WO 99/21626 | | 5/1999 |
| WO | WO 99/51310 | | 10/1999 |
| WO | WO 99/52606 | | 10/1999 |
| WO | WO 00/45067 | A1 | 8/2000 |
| WO | WO 00/51190 | | 8/2000 |
| WO | WO 00/74224 | A1 | 12/2000 |

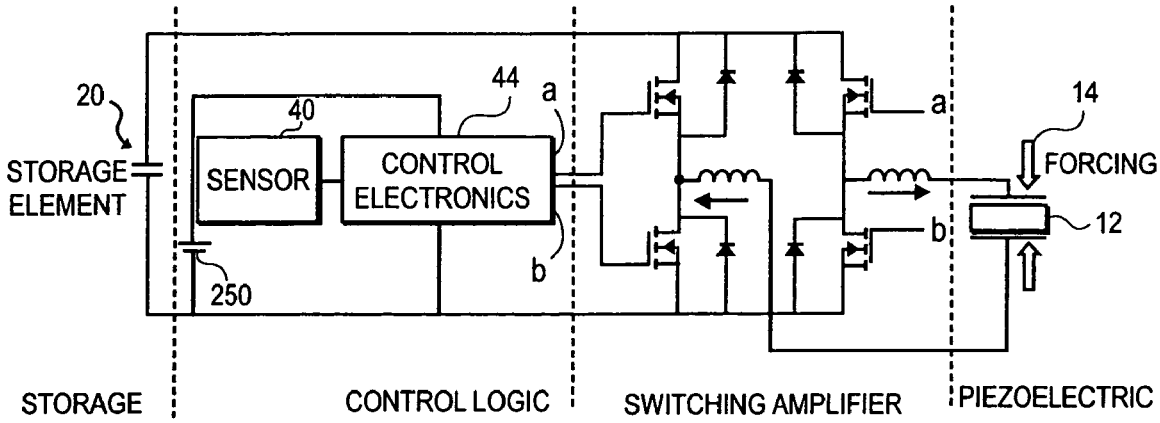
FIG. 11
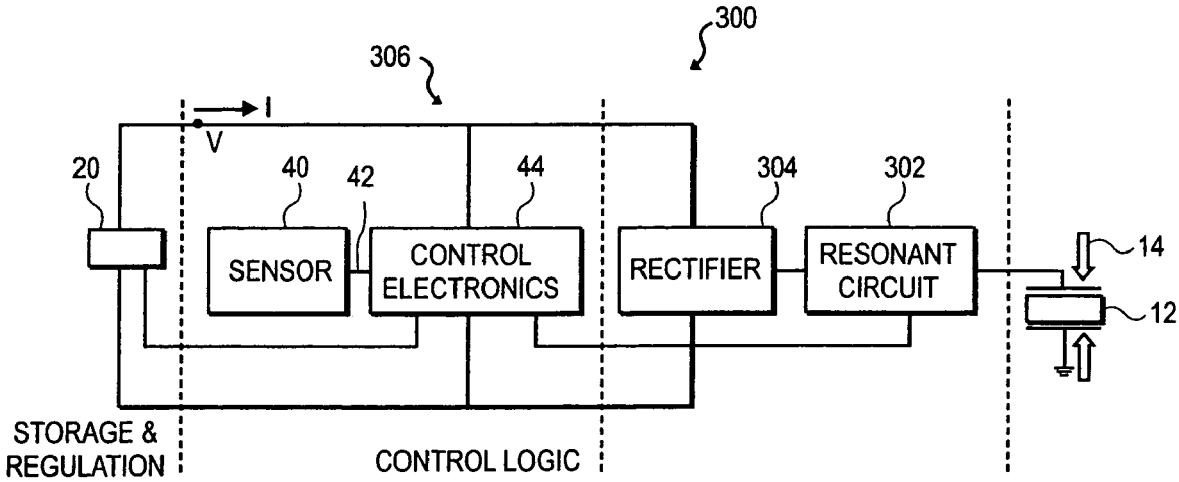
FIG. 12A
FIG. 12B
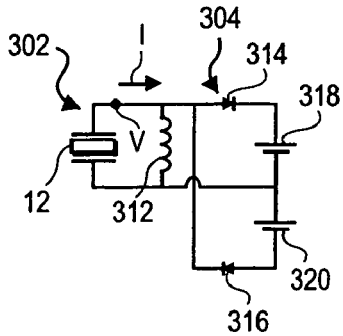

FIG. 17
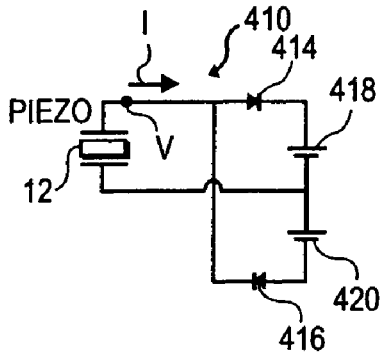
FIG. 18A TRANSDUCER VOLTAGE
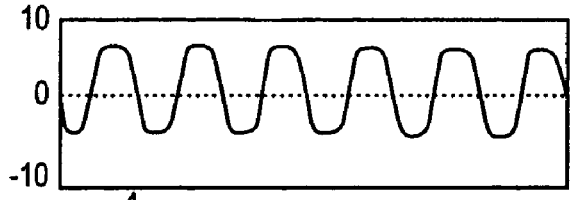
FIG. 18B TRANSDUCER CURRENT
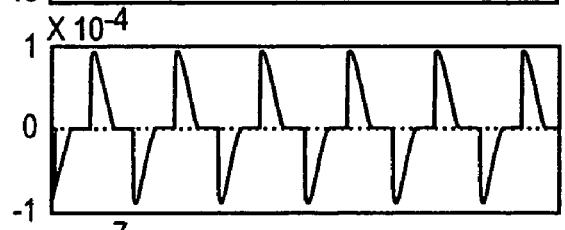
FIG. 18C $Q_{TRANSDUCER}(C)$
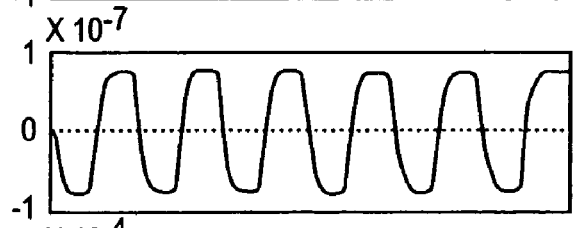
FIG. 18D $P_{TRANSDUCER}(W)$
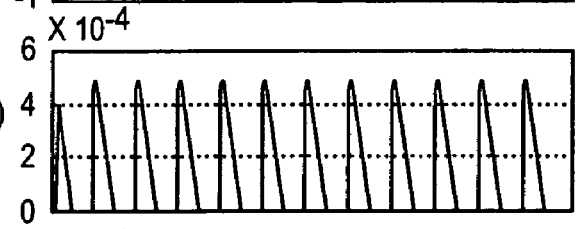
FIG. 18E $P_{EXTRACT}(W)$
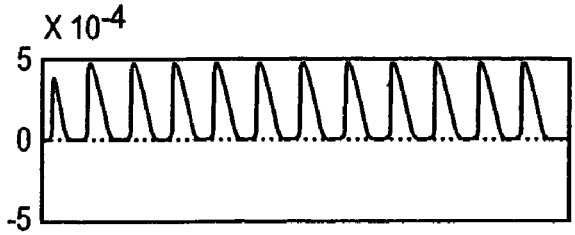
FIG. 18F $E_{EXTRACT}(J)$
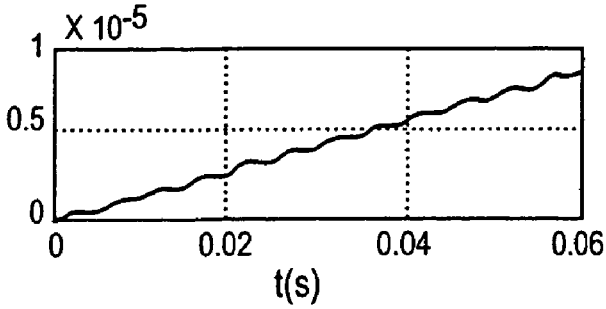

RACKET WITH SELF-POWERED PIEZOELECTRIC DAMPING SYSTEM

This is a continuation of application No. 09/918,437, filed Aug. 1, 2001, which published as U.S. patent application Publication No. U.S. No. 2004/0152544A1 now U.S. Pat. No. 6,974,397, and claims priority to European Patent Application No. 00116596.8, filed Aug. 1, 2000, which published as EP1177816A1, which are incorporated herein by reference.

The present invention generally relates to a racket for ball sports like tennis, squash and racket ball as well as to a method for manufacturing the racket. More particularly, the present invention relates to a racket for ball sports comprising electronics for establishing optimal handling characteristics.

In the prior art, several sports implements including electronics are known. For example, WO-A-97/11756, EP-A-0 857 078 and U.S. Pat. No. 5,857,694 relate to a sports implement comprising a unitary sports body, an electroactive assembly including a piezoelectric strain element for transducing electrical energy and mechanical strain energy, and a circuit connected to the assembly for directing electrical energy via the assembly to control strain in the piezoelectric element so as to damp vibrational response of the body. The electroactive assembly is integrated into the body by a strain coupling. The assembly may be a passive component, converting strain energy to electrical energy and shunting the electrical energy, thus dissipating energy in the body of the sports implement. In an active embodiment, the system includes an electroactive assembly with piezoelectric sheet material and a separate power source such as a replaceable battery. Similar implements are described in WO-A-98/34689, WO-A-99/51310 and WO-A-99/52606.

These known sports implements do not provide satisfying handling properties, e.g., stiffness or damping characteristics. A further disadvantage of the prior art devices is that the electronics either simply dissipates the generated electrical energy with a shunt (e.g. resistor or LED) in the form of a passive assembly or an additional power source (e.g. battery) is provided in order to supply the electronics with electrical energy so as to form an active assembly. Both known alternatives are, however, not completely satisfying with respect to efficiency, weight, handling characteristics and manufacturing aspects.

In accordance with the present invention, the racket is provided with a self-powered electronics being connected to at least one transducer arranged on the racket. More particularly, in accordance with the present invention there is provided a racket for ball sports comprising a frame with a racket head, a throat region, a handle portion, at least one transducer converting upon deformation mechanical energy or power to electrical energy or power and an electrical circuit connected across the transducer. The electrical circuit supplies energy or power to the transducer, wherein all electrical energy or power supplied to the transducer is derived from energy or power extracted from the mechanical deformation. The transducer converts electrical energy or power to mechanical energy or power, wherein the mechanical energy or power influences the oscillation characteristics of the racket. The at least one transducer provided on the racket of the present invention is laminated to the frame.

In an embodiment, the transducer is a composite for actuating or sensing deformation of a structural member comprising a series of flexible, elongated fibers arranged in a parallel array. Each fiber is substantially in parallel with each other, with adjacent fibers being separated by a relatively soft deformable polymer having additives to vary the electric or elasticity properties of the polymer. Furthermore, each fiber has a common poling direction. The composite further includes flexible conductive electrode material along the axial extension of the fibers for imposing or detecting electric fields. The electrode material has an interdigitated pattern forming electrodes of opposite polarity that are spaced alternately and configured to apply a field having compounds along the axes of the fibers. The polymer is interposed between the electrode of the fibers. Preferably, the fibers are electro-ceramic fibers comprising a piezoelectric material. This type of transducer is described in more detail in U.S. Pat. No. 5,869,189.

In one embodiment of the invention the transducers are mounted to the racket in pairs, wherein each pair is arranged at one side of the racket. Where more than one transducer is used, these transducers are preferably all electrically connected to the same electrical circuit. In accordance with an embodiment, this connection is established by means of a so-called flex circuit which can be laminated to the frame of the racket. The electrical circuit, which optionally comprises a storage element for storing power extracted from the at least one transducer, may advantageously be provided in the handle portion of the racket frame.

In the following, further details and advantages of the present invention will be described with reference to embodiments illustrated in the drawings, in which:

FIG. 11 is a circuit diagram of an additional alternative embodiment of a power extraction system;

FIG. 12A is a block diagram of a power extraction system including a resonant circuit and a rectifier;

FIG. 12B is a circuit diagram of a particular embodiment of the power extraction system of FIG. 12A;

FIG. 17 is a circuit diagram of a passive rectifier power extraction system;

FIGS. 18A–18F are various voltage, current, power, and energy waveform diagrams of the circuit of FIG. 17;

Figure 1:
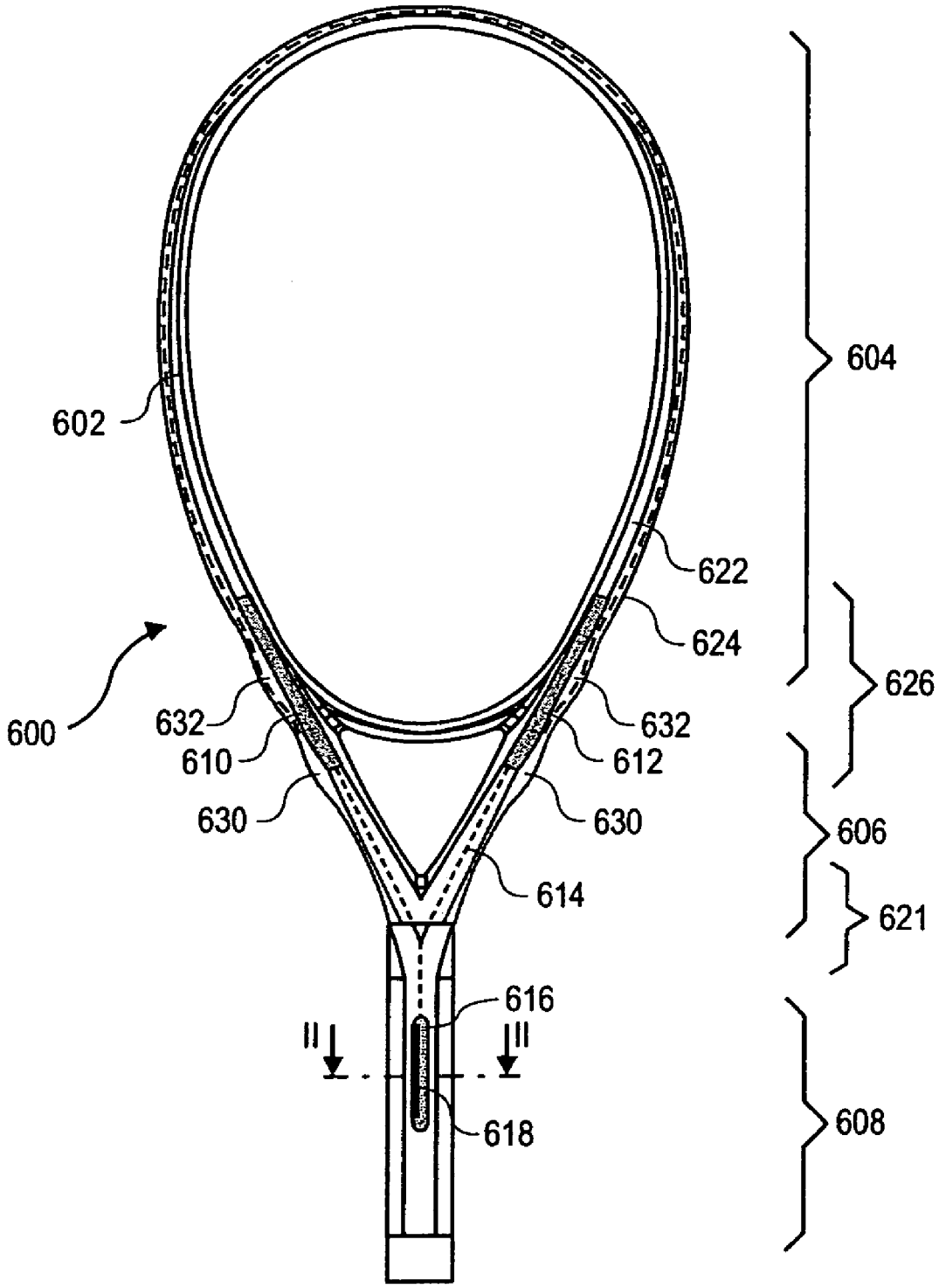
FIG. 1 is a side view of one embodiment of a racket for ball sports in accordance with the present invention.

FIG. 1 shows an embodiment of a tennis racket 600 of the present invention. The racket 600 generally comprises a frame 602 with a racket head 604, a throat region 606 and a handle portion 608. The racket 600 furthermore comprises at least one transducer, preferably one or two pairs of transducers 610 and 612 converting upon deformation mechanical power to electrical power. The transducers 610 and 612 are laminated to the frame 602 of the racket 600 and electrically connected via an electrical connection 614 to a self-powered electrical circuit 618 mounted on an electronics board, and only schematically shown in FIG. 1. The transducers 610 and 612 in combination with the self-powered electrical circuit 618 are intended to improve the handling characteristics of the racket 600 of the present invention. In particular, these elements are intended to reduce vibrations generated during play. For example, when a player hits a ball with the racket 600 of the present invention that incorporates the transducers and the self-powered electrical circuit 618, high frequency vibrations generated during the impact of the ball on the racket are used to extract energy from the transducers 610 and 612. This energy is then transferred via the electrical connection 614 to the electrical circuit 618 that in turn sends a signal back to the transducers 610 and 612 to actuate them so as to dampen the mechanical vibrations.

Figure 2:
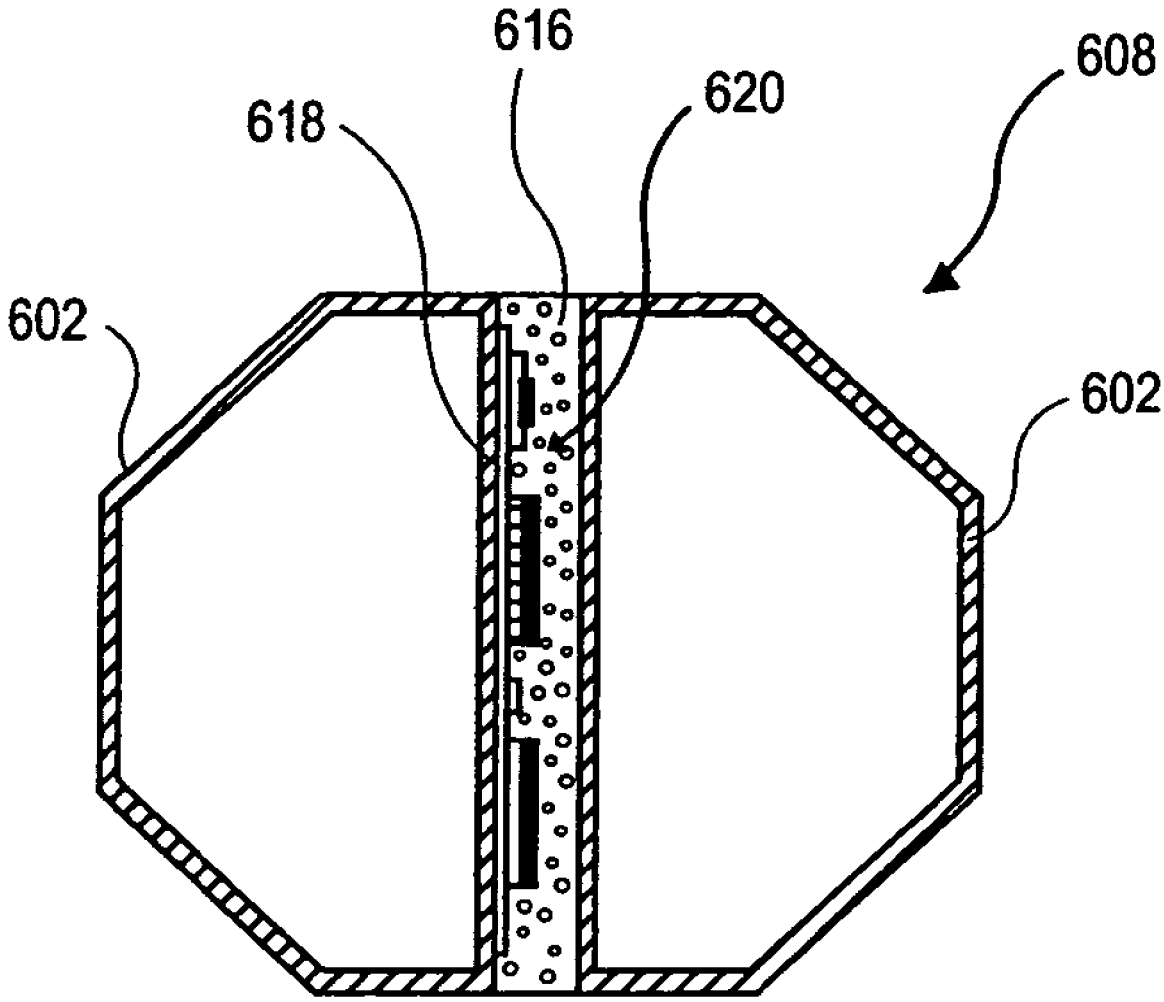
FIG. 2 is a cross-section along line II—II of FIG. 1.

As shown in FIGS. 1 and 2, the handle portion 608 preferably comprises a slot or cut-out 616 in which the self-powered electronics board carrying the electrical circuit 618 is arranged. The cut-out 616 is formed in the handle portion 608 of the racket 600 of the present invention during the manufacturing process of the racket frame 602. This is achieved in that the tube of material, preferably epoxy material or composite carbon fiber material, is put in a mold of a press in the form of a loop. The slot or cut-out 616 in the handle portion 608 is provided in a region in which the two ends of the tube are arranged adjacent one another. In the region of the slot or cut-out 616, these two adjacent tube ends are separated in the mold, e.g., by means of a core, so that after the pressing (preferably at an elevated temperature), a precisely arranged slot or cut-out 616 can be achieved. Alternatively, the racket frame 602 with the slot 616 can be injection molded from a thermoplastic material (e.g., Polyamide). In this case, the electrical circuit 618 may advantageously be integrated in or laminated to the racket frame 602 during the injection molding process.

The cut-out 616 may extend completely through the handle portion 608 in a transverse direction, as can be seen in FIG. 2, but may also be provided to a certain depth only so as to form an appropriate recess for accommodating the electronics board. Although in FIG. 2 the slot 616 is shown in the center of the handle portion 608, it may be provided off the transverse center of the handle portion 608.

The self-powered electrical circuit 618 is provided on the electronics board on which the components of the circuit are mounted. Preferably, the circuit board also carries a storage element for storing power extracted from the transducer. In accordance with a preferred embodiment of the present invention, the cut-out or slot 616 is at least partially filled with a material after the electrical circuit 618 has been arranged therein so as to fix the electrical circuit in place. Preferably, the material fixing the electrical circuit 618 in the slot 616 is a foam 620 that may be filled in the slot 616 and expands its volume so as to fill the cavity in the handle portion 608 of the racket 600 at least partially. Alternatively or additionally, the electrical circuit 618 may be mounted to the handle portion 608 by means of an adhesive either in the slot 616, if present, or directly within the hollow handle portion 608 of the frame 602, e.g., at the partition wall formed where the tube ends meet. Furthermore, the electrical circuit 618 may be mounted on an end cap (not shown) that closes the normally open end of the racket frame 602 at the handle portion 608 so that the electrical circuit 618 extends into the handle portion 608 when the end cap is fixed to the racket 600. Alternatively, the electrical circuit 618 could be arranged at any other location on the racket frame 602, e.g., in a transition area 621 between the handle portion 608 and the throat region 606. In this configuration the electrical circuit 618 is preferably provided as an integrated chip (IC) that is visible through the racket frame 602 from the outside.

The at least one transducer is preferably mounted in a region of the racket 600 where maximum deformation occurs during the use of the racket. More particularly, this region lies on the front surface 622 or its opposite back surface 624 of the racket 600 since maximum deformation can be expected at the largest possible distance from the elastic line of the racket frame 602. Furthermore, it is assumed that the maximum deformation of the racket frame 602 is generated during play in the transition area 626 between the racket head 604 and the throat region 606. It is presently preferred to provide at least one pair of transducers 610 and 612 on the front surface 622 and/or the back surface 624 of the racket frame 602. In other words, the transducers 610 and 612 may be provided on one or both sides of the racket 600. When mounted to one side only, there are a total of two transducers, one per yoke of the frame 602. When mounted to both sides, there are a total of four transducers, one per yoke per side. However, even more transducers may be stacked on each yoke to improve performance of the racket 600.

The at least one transducer laminated to the racket frame 602 preferably comprises silver ink screen-printed interdigitated electrodes (IDE) on polyester substrate material, unidirectionally aligned PZT-5A lead based piezoelectric fibers and thermoset resin matrix material. As already mentioned above, the transducers have a two-fold purpose of sensing and actuating. They are used to sense strain in the racket frame 602 and provide an electrical output via an electrode subsystem to the electrical circuit. They are also used to actuate the racket frame 602 once motion deformation has been detected. In fact, the piezoelectric fibers are transducers and convert mechanical deformation into electrical energy and vice versa. When deformed, they develop a surface charge and, conversely, when an electric field is applied, a deformation is induced. The mechanical strains in the racket due to ball impact deform the transducer, straining the piezoelectric fibers. The interdigitated electrode picks up the surface charges developed by the strained piezoelectric fibers and provides an electric path for the charges to be routed to appropriate electrical circuit 618. Conversely, the interdigitated electrode also provides the electrical path to drive the piezoelectric fibers in the transducer to counter the vibrations induced in the racket 600 by ball impact.

These presently preferred transducers are manufactured in that the piezoelectric fibers and the matrix resin are laminated between two IDE electrodes under specified pressure, temperature and time profiles. The IDE pattern may be used on one or both sides of the composite. The laminated composite is poled at high voltage at specified temperature and time profiles. This process establishes a polar mode of operation of the transducers, necessitating the need to track electrical "ground" polarity on the transducer power lead tabs. More details about this type of transducer and its manufacture may be found in U.S. Pat. No. 5,869,189. A commercially available transducer which is presently preferred to be used with the present invention is an active fiber composite ply known as "Smart Ply" (Continuum Control Corporation, Billerica, Mass., U.S.A.).

The electrical connection 614 between the transducers 610 and 612 and the electrical circuit 618 is preferably established by means of a so-called "flex circuit". For example, such a flex circuit comprises a Y-shaped silver ink screen-printed set of traces on polyester substrate material. A layer of insulating material is applied to the conducting traces except for a region at the three tabs. At the top of the Y-shape, the exposed conductive trace is matched in shape to the above-mentioned tab of the transducer. Solderable pins are crimped to the exposed conductive traces at the bottom of the Y-shape. A 90° bent is present at the bottom end of the "Y" to effectively route the flex circuit into the slot or cut-out 616 for the electronics board carrying the electrical circuit 618 provided in the handle portion 608 of the racket 600.

The electrical circuit 618 used with the racket 600 of the present invention is a self-powered electronics, i.e. no external energy source like a battery is necessary. Preferably, the electrical circuit 618 comprises a printed wiring board (PWB) populated with active and passive components using standard surface mount technology (SMT) techniques. The components of the electrical circuit i.a. include high-voltage MOSFETs, capacitors, resistors, transistors and inductors. The circuit topology used is described in detail below.

The purpose of the electrical circuit or electronics board 618 is to extract the charge from the transducer actuators, temporarily store it, and re-apply it in such a way as to reduce or damp the vibration in the racket 600. The electronics operate by switching twice per first mode cycle at the peak of the voltage waveform. The switching phase shifts the transducer terminal voltage by 90° referenced to the theoretical open circuit voltage. This phase shift extracts energy from the transducer and the racket. The extracted energy increases the terminal voltage by biasing the transducer actuators. The voltage does not build to infinity due to finite losses in the MOSFETs and other electronic components. The switching occurs until enough energy is extracted to reduce the racket vibration, e.g., to approximately 35%, preferably 25% of initial amplitude.

For example, the transducer may be a piezoelectric transducer, an antiferroelectric transducer, an electrostrictive transducer, a piezomagnetic transducer, a magnetostrictive transducer, a magnetic shape memory transducer or a piezoceramic transducer.

The at least one transducer and preferably also the flex circuit are laminated to the racket frame 602 with a suitable resin material under specific temperature, pressure and time profiles. Preferably, the at least one transducer is laminated to the frame 602 by means of the same resin as used for the manufacture of the frame 602 itself. The lamination of the transducers and the flex circuit may either be carried out simultaneously or in an additional step after the frame 602 has been manufactured. After lamination of the transducer and flex circuit to the racket frame 602, an additional protective coating may be applied above the transducer and/or flex circuit. The protective coating may comprise, e.g., glass cloths or glass fiber mats and/or a lacquer or varnish. It is preferred that each of the transducers mounted to the racket 600 of the present invention has a size of about 8 to 16 $cm^2$, preferably about 10 to 14 $cm^2$ and most preferably about 12 $cm^2$.

With respect to the frame 602 of the racket 600 of the present invention, it is particularly preferred that the frame has a profile exhibiting different cross-sectional shapes at different frame positions according to the kinds of main stress occurring there, wherein the cross-sectional shapes have section moduli adapted to the respective kinds of stress. For example, the frame 602 may be provided with substantially rectangular or ellipsoidal cross-sectional profiles in areas in which bending occurs or with substantially circular cross-sections in areas in which portion occurs. In addition, hunch-like stiffening elements 630 and 632 may be provided at the frame 602, as shown in FIG. 1. In particular, the hunch-like stiffening elements 632 may be provided in an area between 4 and 6 o'clock as well as between 6 and 8 o'clock, respectively. The stiffening elements 630, which may be provided instead of or in addition to the stiffening elements 632, are located at the throat region 606 of the frame 602 of the racket 600 of the present invention. The axial ratio of the profile, i.e. the ratio between the height and the width of the profile in the area of the hunch 630 and/or 632, is between 1.0 and 1.4, preferably between 1.2 and 1.35.

In the following, preferred embodiments of the electrical circuit 618 will be described with reference to FIGS. 3A to 32.

Figure 3A:
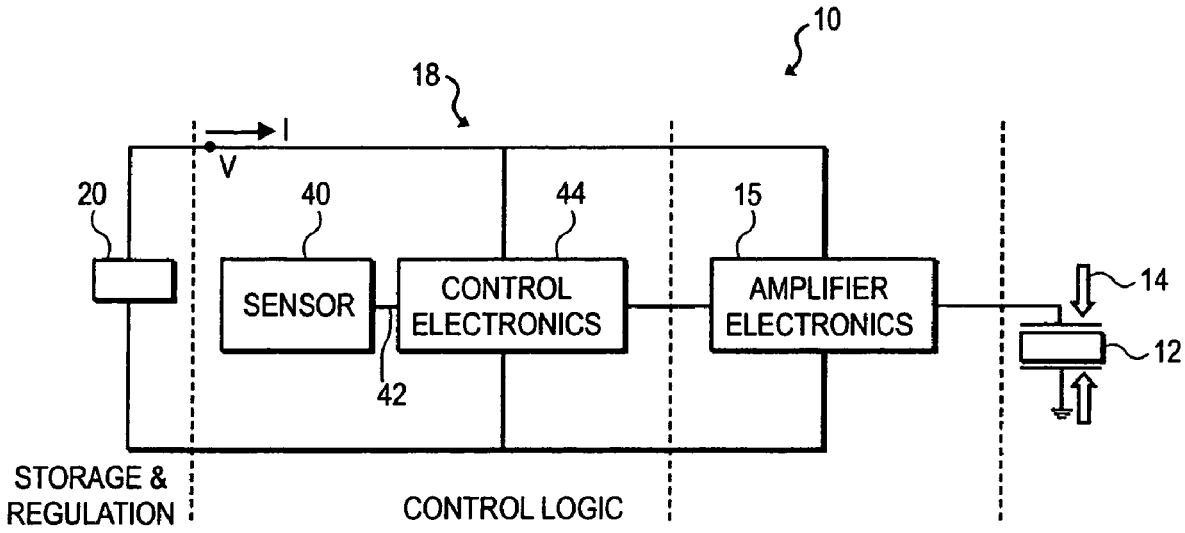
FIG. 3A is a block diagram of an embodiment of a power extraction system which may be used with the racket of the invention.

Referring to FIG. 3A, an electronic circuit 10 for extracting electrical power from a transducer 12 acted upon by a disturbance 14, e.g., a deformation in response to a ball contact of the racket 600, includes amplifier electronics 15, for example, any amplifier that allows bi-directional power flow to and from transducer 12 such as a switching amplifier, a switched capacitor amplifier, or a capacitive charge pump;

control logic 18; and a storage element 20, for example, a capacitor. Amplifier electronics 15 provides for flow of electrical power from transducer 12 to storage element 20, as well as from storage element 20 to transducer 12.

Figure 3B:
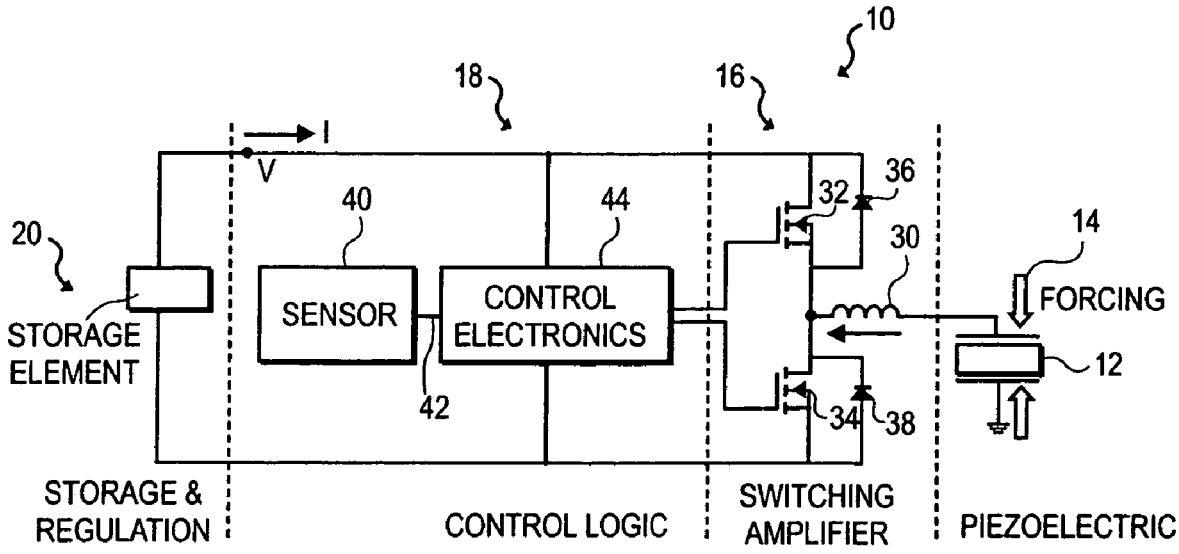
FIG. 3B is a circuit diagram of a particular embodiment of the power extraction system of FIG. 3A.

Referring to FIG. 3B, a switching amplifier 16 includes switches, for example, MOSFETs 32, 34, bipolar transistors, IGBTs, or SCRs, arranged in a half bridge, and diodes 36, 38. (Alternatively the switches can be bidirectional with no diodes.) MOSFETs 32, 34 are switched on and off at high frequencies of, for example, between about 10 kHz–100 kHz. Switching amplifier 16 connects to transducer 12 through an inductor 30. The value of inductor 30 is selected such that inductor 30 is tuned below the high frequency switching of MOSFETs 32, 34 and above the highest frequency of importance in the energy of disturbance 14 with inductor 30 acting to filter the high frequency switching signals of circuit 16.

The current flow through inductor 30 is determined by the switching of MOSFETs 32, 34 and can be divided into four phases:

- Phase I: MOSFET 32 is off, MOSFET 34 is switched on, the current in inductor 30 increases as the inductor stores energy from transducer 12.
- Phase II: MOSFET 34 is turned off and MOSFET 32 is switched on, the current is forced through diode 36 and onto storage element 20 as inductor 30 releases the energy.
- Phase III: As the current in inductor 30 becomes negative the current stops flowing through diode 36 and flows through MOSFET 32, and energy from storage element 20 is transferred to inductor 30.
- Phase IV: MOSFET 32 is then turned off and MOSFET 34 is turned on, current flowing through diode 38 increases, and the energy stored in inductor 30 is transferred to transducer 12.

Figure 4A:
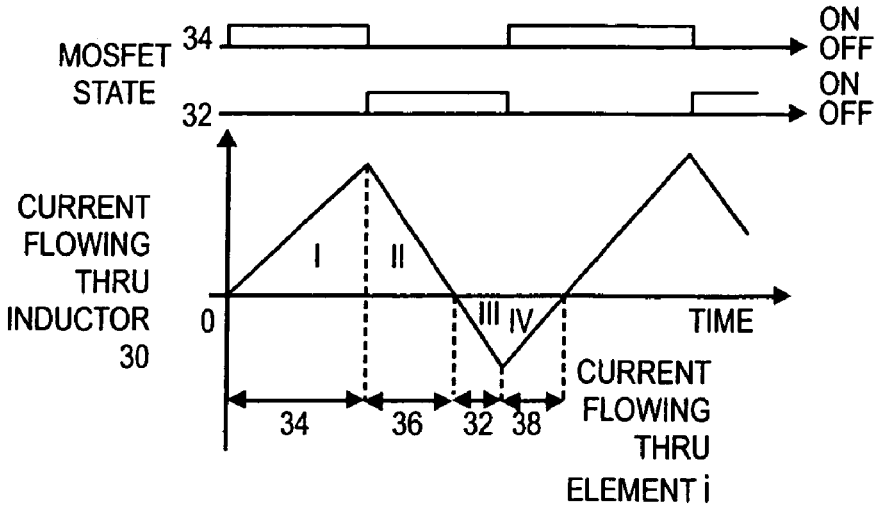
FIG. 4A is a graph of the phases of current flow through an inductor of the circuit of FIG. 3B.
Figure 4B:
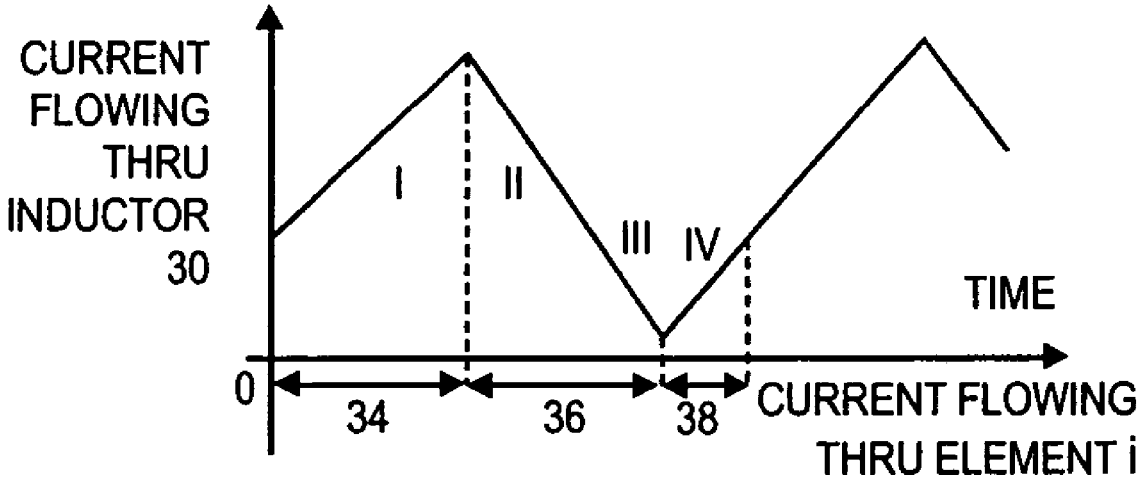
FIGS. 4B and 4C show alternative current flows through the inductor.
Figure 4C:
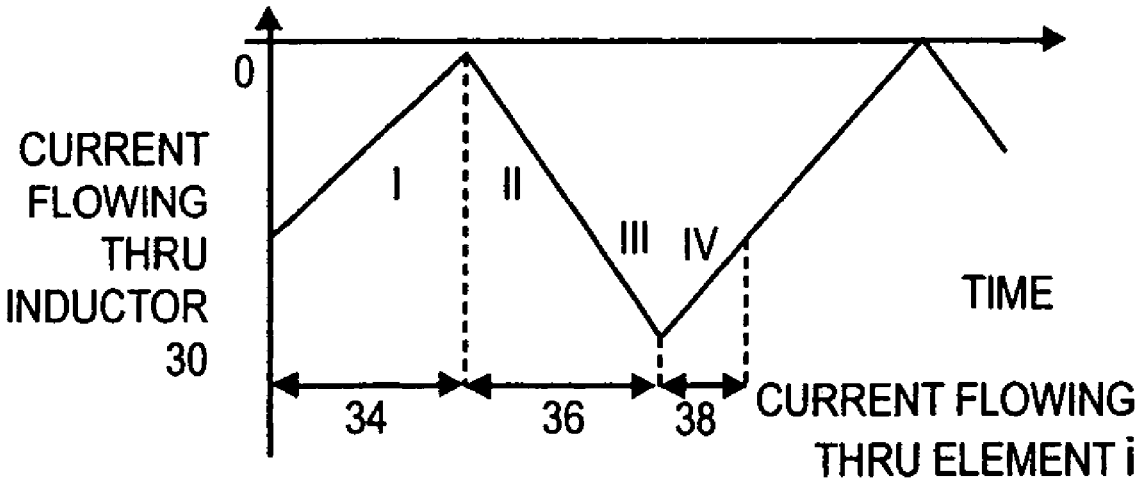

FIG. 4A is a graphical representation of the four phases showing (i) the current through inductor 30 versus time, (ii) which MOSFET or diode current is flowing through in each phase, and (iii) the state of the MOSFETs in each phase. The net current during the switching phases may be positive or negative depending on the state of the disturbance and the duty cycle of the switches. Referring to FIG. 4B, the current may be positive during all four phases in which case the current flows through switch 34 and diode 36. Alternatively, referring to FIG. 4C, the current may be negative during all four phases, in which case the current flows through switch 32 and diode 38.

MOSFET 32 can be off during phase 11, and MOSFET 34 can be off during phase IV without affecting the current flow since no current flows through these MOSFETs during the respective phases. If MOSFETs 32, 34 are on during phases II and IV, respectively, a deadtime can be inserted between the turning off of one MOSFET and the turning on of another MOSFET to reduce switching losses from cross conductance across MOSFETs 32, 34.

Figure 5A:
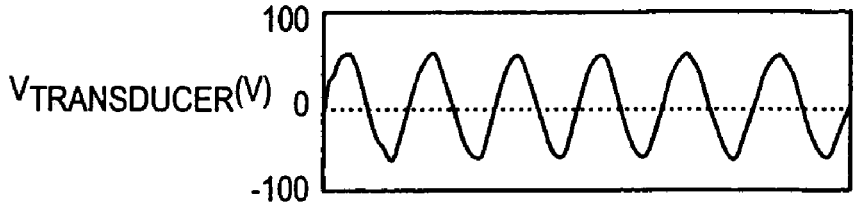
FIGS. 5A–5G are various voltage, current, power, and energy waveform diagrams of the circuit of FIG. 3B.
Figure 5B:
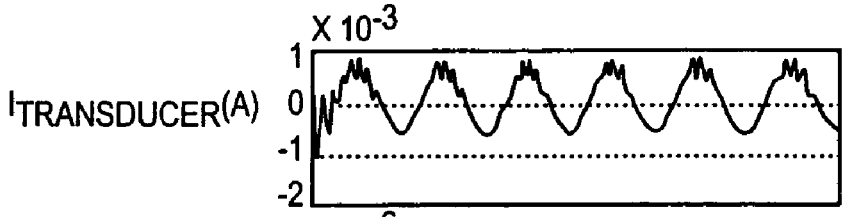
Figure 5C:
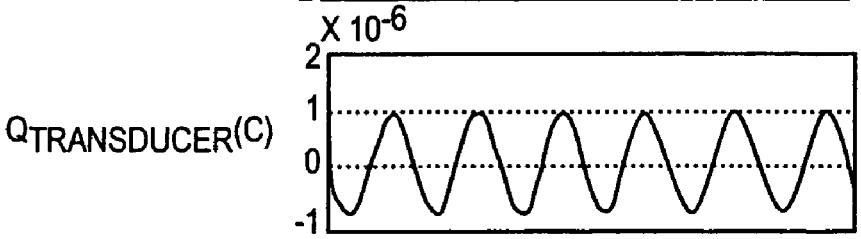
Figure 5D:
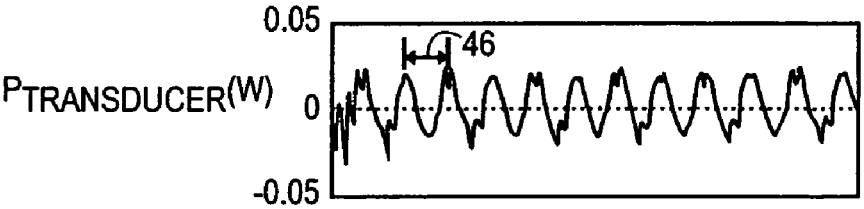
Figure 5E:
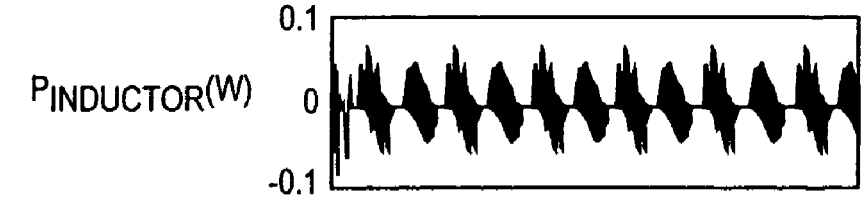
Figure 5F:
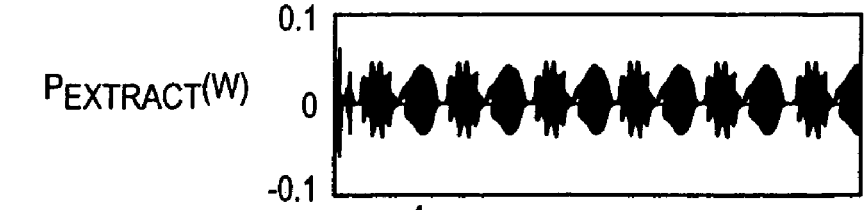
Figure 5G:
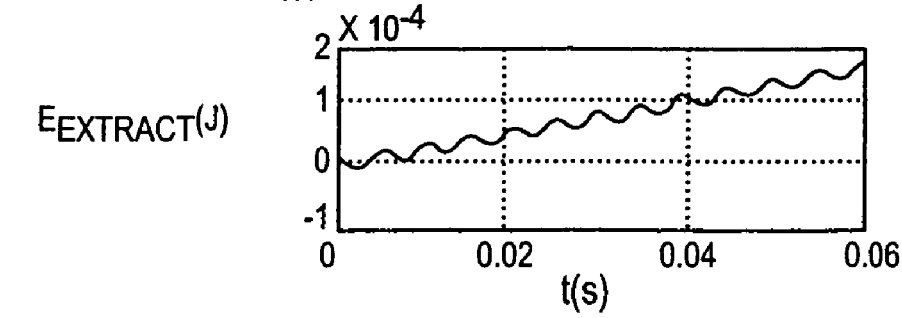
Figure 6A:
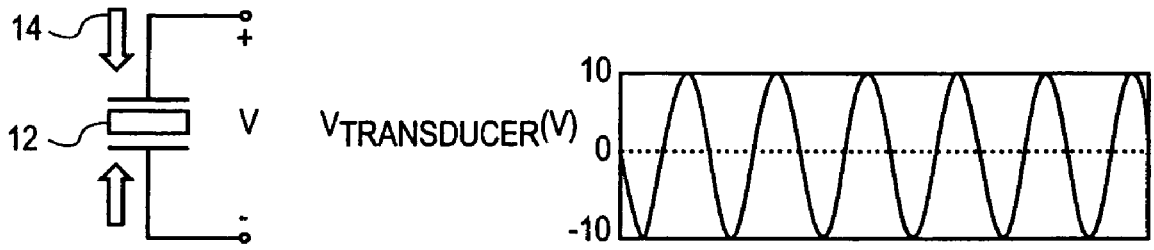
FIG. 6A is a waveform of the voltage across an open circuit transducer.
Figure 6B:
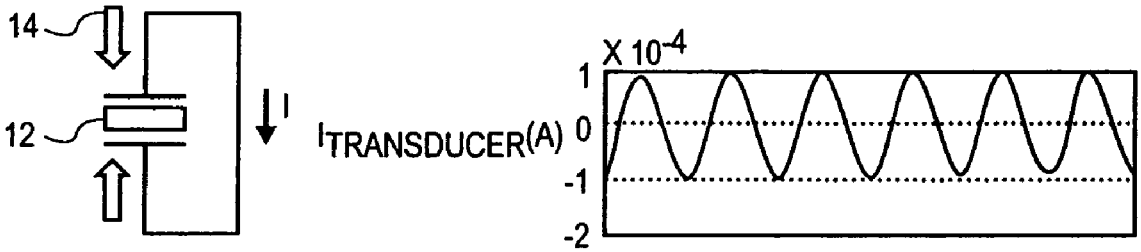
FIG. 6B is a waveform of the current passing through a short circuit transducer.
Figure 6C:
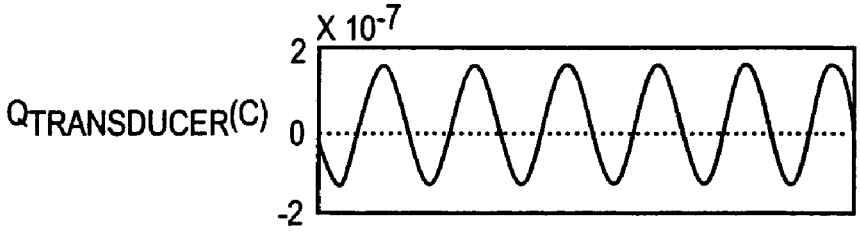
FIG. 6C is a waveform of the charge passing through a short circuit transducer.

Referring to FIGS. 5A–5G, an example of the power extracted from transducer 12 is graphically represented where the amplitude of the voltage across an open circuit transducer would have been 10 volts (see FIG. 6A). In this example, transducer 12 is a PZT-5H piezoelectric transducer-with a thickness of 2 mm and an area of 10 $cm^2$ . The properties of this transducer are: compliance $S^E_{33}=2.07\times10\text{-}^{11}$ $m^2/N$, dielectric $\epsilon^T_{33}/\epsilon_0=3400$, and coupling coefficient $d_{33}=593\times10^{-12}$ m/V. The capacitance of this transducer is 15 nF. The following waveforms correspond to a 100 Hz sinusoidal disturbance with an amplitude of 250 N through the thickness direction, which would produce an open circuit voltage of 10 V on the transducer.

FIG. 5A shows the voltage across transducer 12 as a function of time. The peak amplitude of the voltage is greater than twice any peak voltage of an open circuit transducer. Here, the peak amplitude of the voltage is about 60 volts. FIG. 5B shows the current waveform on transducer 12 and FIG. 5C the charge waveform on transducer 12. Due to the flow of current from storage element 20 to transducer 12, the peak of the integral of the current onto and off transducer 12 is greater than two times higher than any peak of an integral of a current of a short circuit transducer due to the disturbance alone (see FIGS. 6B and 6C).

Due to the phasing of the voltage and current waveforms, the power to and from transducer 12, FIG. 5D, alternates between peaks of about 0.021 Wafts and −0.016 Wafts. Thus, power flows to transducer 12 from storage element 20 and from transducer 12 to storage element 20 during the course of disturbance 14 on transducer 12, for example, during a single sinusoidal cycle 46, with the net power flowing from transducer 12 to storage element 20. The cycle need not be sinusoidal, for example, where the disturbance has multiple frequency harmonics or broad frequency content such as in a square wave, a triangular wave, a saw tooth wave, and white noise bandwidth limited or otherwise.

The power into inductor 30 is shown in FIG. 5E. The high frequency switching of MOSFETs 32, 34, described above, is seen in the power waveform. Where the waveform is positive, power is being stored in inductor 30, and where the waveform is negative, power is being discharged from inductor 30.

The extracted power and energy are shown in FIGS. 5F and 5G. Over a period of 0.06 seconds, approximately $1.5\times10^{-4}$ Joules of energy are extracted. An advantage of circuit 10 is that a higher peak voltage and peak charge are seen by the transducer than would otherwise occur and thus higher power can be extracted from the input disturbance. By applying a voltage to transducer 12 having an appropriate amplitude and phasing relative to disturbance 14, transducer 12 will undergo more mechanical deflection under the load than would otherwise occur. Thus, more work is done on transducer 12 by disturbance 14 and more energy can be extracted by circuit 10.

Referring again to FIG. 3B, the duty cycle of MOSFETs 32, 34 is controlled by measuring the motion of disturbance 14 and selecting a time-varying duty cycle to match the motion of disturbance 14. This provides for effective power extraction over a wide frequency range of the disturbance. Control logic 18 includes a sensor 40, for example, a strain gage, micropressure sensor, PVDF film, accelerometer, or composite sensor such as an active fiber composite sensor, which measures the motion or some other property of disturbance 14, and a control electronics 44. Sensor 40 supplies a sensor signal 42 to control electronics 44 which drive MOSFETs 32, 34 of switching amplifier 16. System states which sensor 40 can measure include, for example, vibration amplitude, vibration mode, physical strain, position, displacement, acceleration, electrical or mechanical states such as force, pressure, voltage or current, and any combination thereof or rate of change of these, as well as temperature, humidity, altitude, or air speed orientation. In general any physically measurably quantity which corresponds to a mechanical or electrical property of the system.

Possible control methods or processes for determining the duty cycle of MOSFETs 32, 34 include rate feedback, positive position feedback, position-integral-derivative feedback (PID), linear quadratic Gaussian (LQG), model based controllers, or any of a multitude of dynamic compensators.

For the example described above with reference to FIGS. 5A–5G, with a disturbance of 100 Hz, a switching frequency of 100 kHz was used. An inductor value of 1.68 H was selected such that the time constant of inductor 30 and transducer 12 corresponds to 1,000 Hz. The duty cycle of MOSFETs 32, 34 was controlled using rate feedback. The voltage on storage element 20 was set to 60 volts.

Referring to FIG. 3A, in other alternative control methods or processes for extracting power from transducer 12, the duty cycle of controlled switches in circuit 15 is specified based on the governing equations for a Boost or Buck converter such that the transducer voltage is stepped up or down to the voltage on the storage element. The Boost converter allows extraction of power from transducer 12 when the open circuit voltage developed across transducer 12 is lower than the voltage on storage element 20. The Buck converter allows efficient extraction, of power from transducer 12 when the open circuit voltage developed across transducer 12 is higher than the voltage on storage element 20.

The control methods or processes can include a shut down mode of operation such that when the magnitude of the voltage across transducer 12 is below a certain limit, MOSFETs 32, 34 and portions of the supporting electronics are turned off to prevent unnecessary dissipation of power from storage element 20. Alternatively, MOSFETs 32, 34 can be shut down when the duty cycle required by the control method is above or below a certain threshold.

Figure 7:
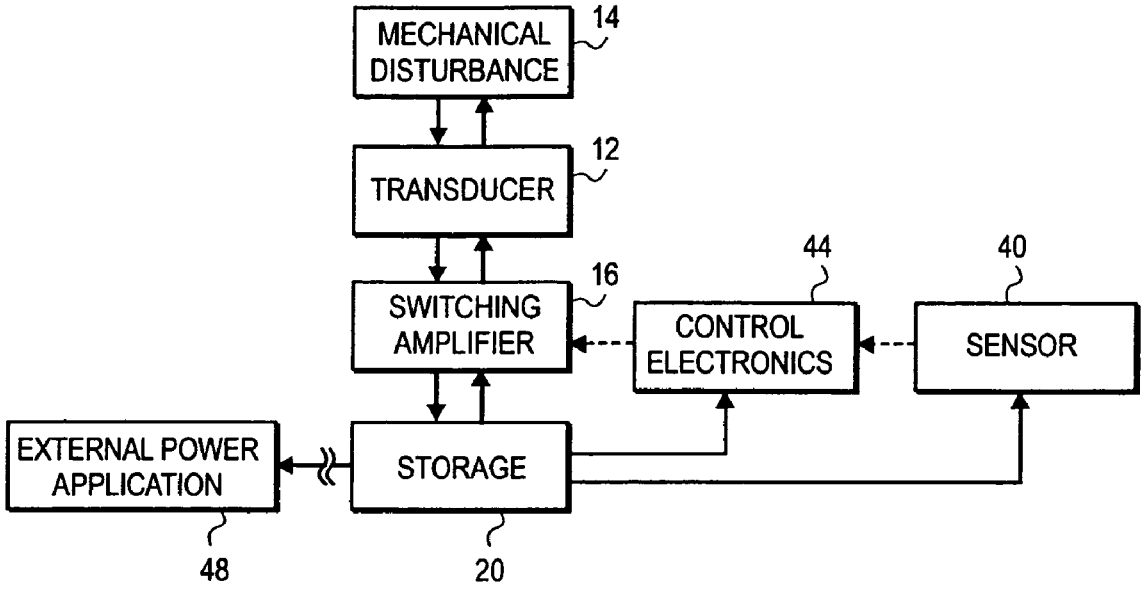
FIG. 7 is a block diagram of the power extraction system of FIG. 3B.

FIG. 7 shows the flow of power between disturbance 14 and storage element 20, and the flow of information (dashed lines). The power from mechanical disturbance 14 is transferred to transducer 12 which converts the mechanical power to electrical power. The power from transducer 12 is transferred to storage element 20 through switching amplifier 16. Power can also flow from storage element 20 to transducer 12 through switching amplifier 16. Transducer 12 can then convert any received electrical power to mechanical power which in turn acts upon a structure 602 (FIG. 8) creating disturbance 14. The net power flows to storage element 20.

The power for sensor 40 and control electronics 44 as well as the cyclic peak power needed by transducer 12 is supplied by the energy accumulated in storage element 20, which has been extracted from disturbance 14. Energy accumulated in storage element 20 can also or alternatively be used to power an external application 48 or the power extraction circuitry itself.

Losses in the system include losses in energy conversion by transducer 12, losses due to voltage drops at diodes 36, 38 and MOSFETs 32, 34, switching losses, and losses due to parasitic resistances or capacitances through circuit 10.

The control methods or processes can vary dependent upon whether maximum power generation is desired or self-powering of a transducer acting as a vibration damping actuator is desired. When maximum power generation is desired a feedback control loop uses the signal from sensor 40 to direct MOSFETs 32, 34 to apply a voltage to transducer 12 which acts to increase the mechanical work on transducer 12 contracting and expanding transducer 12 in phase with disturbance 14 essentially softening transducer 12 to disturbance 14. More energy is extracted from disturbance 14, however vibration of the structure 602 (FIG. 8) creating disturbance 14 may be increased.

When transducer 20 is being used to dampen vibration of mechanical disturbance 14, a feedback control loop uses the signal from sensor 40 to adjust the duty cycle of MOSFETs 32, 34 to apply a voltage to transducer 12 which will act to damp the vibrations. The system provides self-powered vibration dampening in that power generated by transducer 12 is used to power transducer 12 for dampening.

Figure 8:
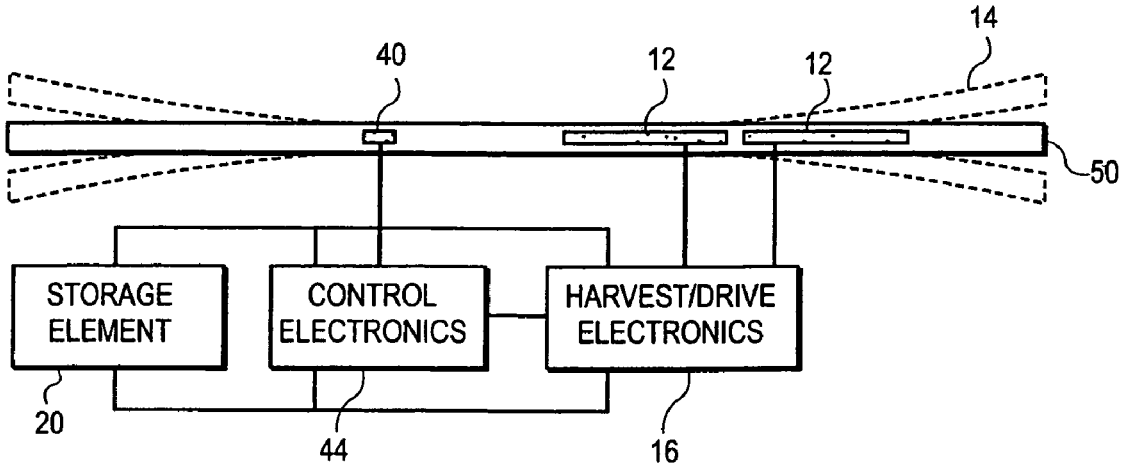
FIG. 8 shows an implementation of the power extraction system of FIG. 3B with a transducer of the system mounted to a structure.

Referring to FIG. 8, one or more transducers 12 can be attached, laminated to one or more locations on the racket frame 602, and connected to one harvesting/d rive circuit 16 (or more than one harvesting/d rive circuit). Deformation of the racket frame 602 creates mechanical disturbance 14 on transducer 12.

Transducer 12 is, for example, a piezoelectric transducer, an antiferroelectric transducer, an electrostrictive transducer, a piezomagnetic transducer, a magnetostrictive transducer, or a magnetic shape memory transducer. Examples of piezoelectric transducers include polycrystaline ceramics such as PZT 5H, PZT 4, PZT 8, PMN-PT, fine grain PZT, and PLZT; polymers such as electrostrictive and ferroelectric polymers, for example, PVDF and PVDF-TFE; single crystal ferroelectric materials such as PZN—PT, PMN—PT, NaBiTi—BaTi, and BaTi; and composites of these materials such as active fiber composites and particulate composites, generally with 1-3, 3-3, 0-3 or 2-2 connectivity patterns.

Possible mechanical configurations of transducer 12 include a disk or sheet in through thickness (33) mode, in transverse (31) or planar (p) mode, or shear (15) mode, single or multilayer, bimorph, monomorph, stack configuration in through thickness (33) mode, rod or fiber poled transverse or along fiber, ring, cylinder or tube poled radially, circumferentially or axially, spheres poled radially, rolls, laminated for magnetic systems. Transducer 12 can be integrated into a mechanical device which transforms forces/pressures and deformation external to the device into appropriate, advantageous forces/pressures and deformation on transducer 12.

Disturbance 14 can be an applied force, an applied displacement, or a combination thereof. For a disturbance applied to transducer 12 in the 33 direction, if the system is designed specifying the stress amplitude on transducer 12, the material from which transducer 12 is formed should be selected which maximizes $k_{gen}^2 s_{gen}^E$, for example, $k_{33}^2 s_{33}^E$. If the system is designed specifying the strain on transducer 12, a material should be selected which maximizes $k_{gen}^2/s_{gen}^D$, for example, $k_{33}^2/s_{33}^D$. Where $k_{gen}$ is the effective material coupling coefficient for the particular generalized disturbance on transducer 12, $s_{gen}^E$ is the effective compliance relating the generalized disturbance or displacement of the transducer in the short circuit condition, and $s^{gen D}$ is the effective compliance relating the generalized disturbance or displacement of the transducer in an open circuit condition.

Figure 9:
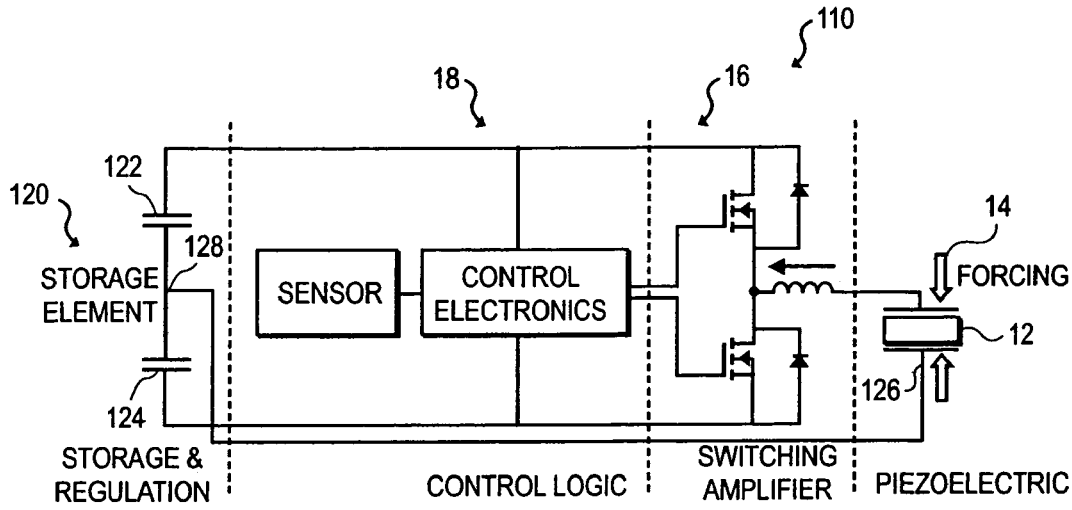
FIG. 9 is a circuit diagram of an alternative embodiment of a power extraction system.

Referring to FIG. 9, in another preferred embodiment, a circuit 110 for extracting power from transducer 12 includes a storage element 120 which includes two storage components 122, 124 connected in series. One side 126 of transducer 12 is connected to a middle node 128 of components 122, 124. This connection biases transducer 12, permitting operation of circuit 110 when the voltage on transducer 12 is positive or negative.

Figure 10:
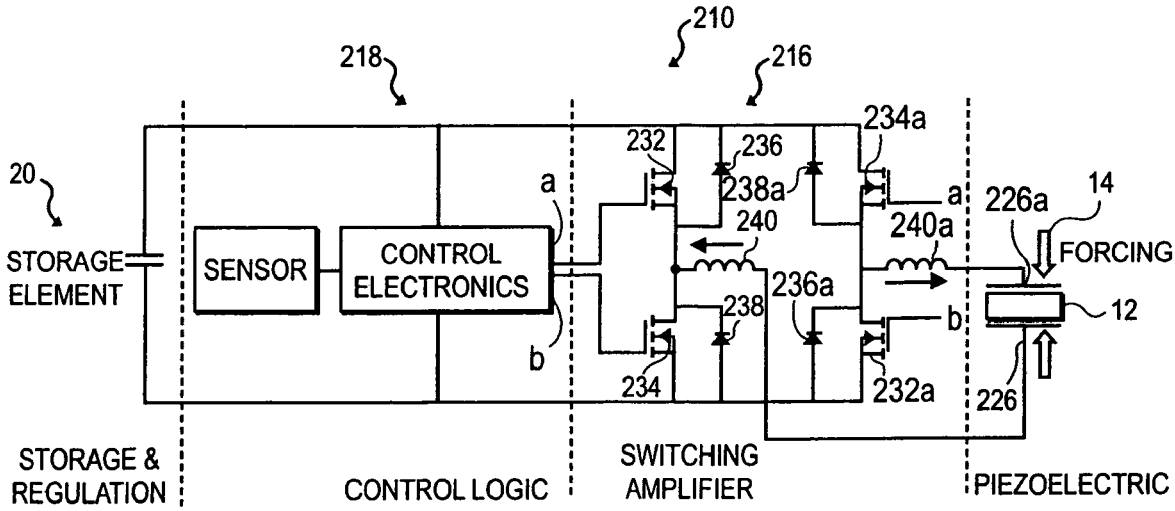
FIG. 10 is a circuit diagram of an additional alternative embodiment of a power extraction system.

Referring to FIG. 10, a circuit 210 includes an H-bridge switching amplifier 216. In a first approach, control logic 218 operates MOSFETs 232, 232*a* together, and MOSFETs 234, 234*a* together:

Phase I: MOSFETs 232, 232*a* are off, MOSFETs 234, 234*a* are turned on, current flows through MOSFETs 234, 234*a*, and energy from transducer 12 is stored in inductors 240, 240*a*.

Phase II: MOSFETs 234, 234*a* are turned off and MOSFETs 232, 232*a* are switched on, current flows through diodes 236, 236*a*, and the energy stored in inductors 240, 240*a* is transferred to storage element 20.

Phase III: As the current becomes negative, the current stops flowing through diodes 236, 236*a* and flows through MOSFETs 232, 232*a*, and energy from storage element 20 is transferred to inductors 240, 240*a*.

Phase IV: MOSFETs 232, 232*a* are turned off, current flowing through diodes 238, 238*a* increases, and the energy stored in inductors 240, 240*a* is transferred to transducer 12.

In a second operational approach, only half of the H-bridge is operated at any given time, depending upon the polarity of the voltage desired on transducer 12. When a positive voltage is desired, MOSFET 234*a* is turned off and MOSFET 232*a* is tuned on, grounding side 226*a* of transducer 12. MOSFETs 232 and 234 are then turned on and off as described above with reference to FIG. 4, to affect the voltage on side 226 of transducer 12. When a negative voltage on transducer 12 is desired, MOSFET 232 is turned off and MOSFET 234 is turned on, grounding side 226 of transducer 12. MOSFETs 232*a* and 234*a* are then turned on and off as described above with reference to FIG. 4, to affect the voltage on side 226*a* of transducer 12.

Referring to FIG. 11, the circuit of FIG. 10 has been modified by including an independent power source, for example, a battery 250, which powers sensor 40 and control electronics 44. Storage element 20 still stores power to be transferred to and received from transducer 20.

Referring to FIG. 12A, a simplified, resonant power extracting circuit 300 can be employed in place of amplifier electronics 15 for extracting power from transducer 12. Circuit 300 includes a resonant circuit 302, a rectifier 304, control logic 306, and a storage element 20, for example, a rechargeable battery or capacitor. Resonant circuit 302 includes elements such as capacitors and inductors which when coupled to the transducer produce electrical resonances in the system. Resonant circuit 302 provides for flow of electrical power from and to transducer 12. Sensor 40 and control electronics 308 can be used to adapt the voltage level of storage element 20 using, for example, a shunt regulator, or tune the resonant circuit by switching on different inductors or capacitors within a bank of components with different values.

For example, referring to FIG. 12B, a piezoelectric transducer 12 is connected to a resonant circuit 302 formed by an inductor 312. Resonant circuit 302 is effective in a narrow frequency band dependent upon the value of inductor 312. The value of inductor 312 is selected such that the resonant frequency of the capacitance of transducer 12 and the inductance of inductor 312 is tuned to or near the dominant frequency, frequencies or range of frequencies of disturbance 14 or the resonance of the mechanical system. Rectifier 304 is a voltage doubling rectifier including diodes 314, 316. Power extracted from transducer 12 is stored in storage elements 318, 320.

For a magnetostrictive transducer 12, the resonant circuit 302 can include a capacitor connected in parallel with transducer 12.

The amplitude of the voltage across inductor 312 grows as a result of resonance until the voltage is large enough to forward bias one of diodes 314, 316. This occurs when the voltage across inductor 312 is greater than the voltage across one of storage elements 318, 320.

In the case of a sinusoidal disturbance, as provided in a racket for ball sports, the current flow through circuit 310 can be described in four phases:

Phase I: As the transducer voltage increases from zero, no current flows through diodes 314, 316 while the transducer voltage is less than the voltage on storage elements 318, 320.

Phase II: When the transducer voltage grows larger than the voltage on storage element 318, diode 314 becomes forward biased, and current flows through diode 314 into storage element 318.

Phase III: As the transducer voltage drops, diodes 314, 316 are reverse-biased and again no current flows through the diodes.

Phase IV: When the transducer voltage goes negative and has a magnitude greater than the voltage on storage element 320, diode 316 becomes forward biased, and current flows through diode 316 into storage element 320. As the transducer voltage begins to increase, diodes 314, 316 are reverse-biased again and phase I repeats.

Referring to FIGS. 13A–13G, an example of the power extracted from transducer 12 in circuit 310 is graphically represented where the open circuit amplitude of the voltage across transducer 12 would have been 10 volts. The same transducer and disturbance described above with reference to FIGS. 5 are used in this example. A 168H inductor is used in this example such that the time constant of the inductor and transducer corresponds to 100 Hz.

Figures 13A, 13B, 13C, 13D, 13E, 13F, 13G:
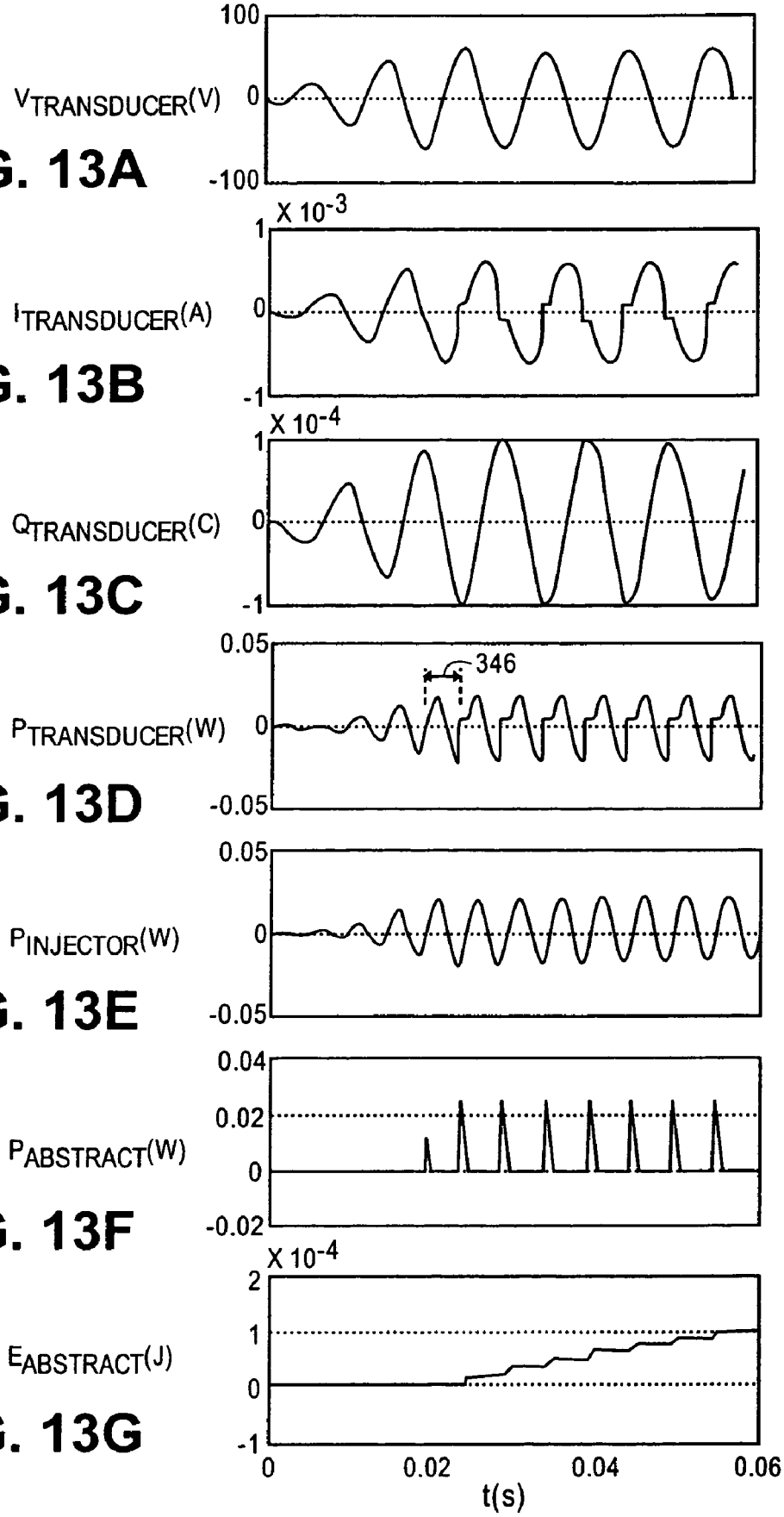
FIGS. 13A–13G are various voltage, current, power, and energy waveform diagrams of the circuit of FIG. 12B.

FIG. 13A shows the voltage across transducer 12 of FIG. 12 as a function of time. The peak amplitude of the voltage grows as a result of resonance until it is greater than the voltage on storage elements 318, 320. This voltage is greater than twice any peak voltage of the open circuit voltage of transducer 12 due to disturbance 14 alone (see FIG. 6A). Here, the peak amplitude of the voltage is about 60 volts. (The circuit can act in pure transient scenarios although transient to steady state is shown.)

FIG. 13B shows the current waveform on transducer 12 and FIG. 13C the charge waveform on transducer 12. Due to the resonance of the circuit, the peak of the integral of the current onto and off transducer 12 is greater than two times higher than any peak of an integral of a current of a short circuit transducer due to the disturbance alone (see FIGS. 6B and 6C).

Due to the phasing of the voltage and current waveforms, the power flow to and from transducer 12, FIG. 13D, alternates between peaks of about 0.02 and −0.02 Watts. Thus, power flows to transducer 12 from resonator circuit 312 and from transducer 12 to resonator circuit 312 during the course of disturbance 14 on transducer 12, for example, during a single sinusoidal cycle 346, with the net power flowing from transducer 12 to storage element 318, 320. The cycle need not be sinusoidal, for example, where the disturbance has multiple frequency harmonics or broad frequency content such as in a square wave, a triangular wave, a saw tooth wave, and broadband noise.

The power into inductor 312 is shown in FIG. 13E. Where the waveform is positive, power is being stored in inductor 312, and where the waveform is negative, power is being discharged from inductor 312.

The extracted power and energy are shown in FIGS. 13F and 13G. Over a period of 0.06 seconds, approximately $1.0\times10^{-4}$ Joules of energy are extracted.

The voltage across storage elements 318, 320 is tuned to optimize the efficiency of the power extraction. For example, voltage across storage elements 318, 320 is optimally about half the peak steady state voltage across the transducer if no rectifier were coupled to the transducer and the transducer and inductor connected in parallel were resonating under the same disturbance. An adaptive system uses a sensor to adapt to changing system frequencies, damping, or behavior to adapt the resonator or adapt the storage element voltage level.

Figure 14:
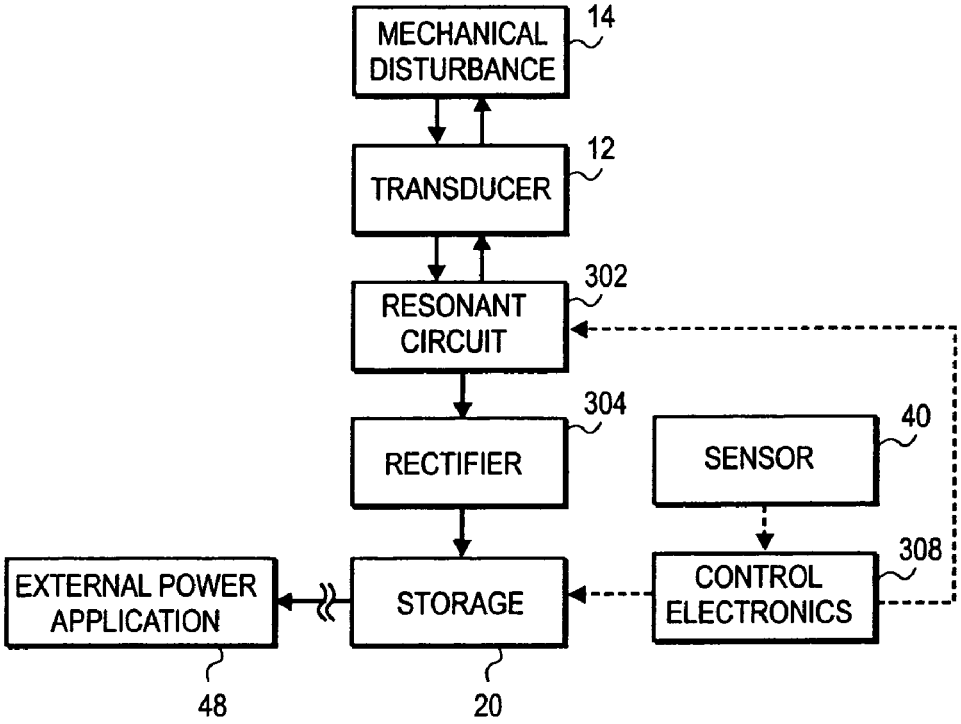
FIG. 14 is a block diagram of the power extraction system of FIG. 12B.

FIG. 14 shows the flow of power between disturbance 14 and storage element 20, and the flow of information (dashed lines). The power from mechanical disturbance 14 is transferred to transducer 12 which converts the mechanical power to electrical power. The power from transducer 12 is transferred to storage element 20 through resonant circuit 302 and rectifier 304. Power can also flow from resonant circuit 302 to transducer 12. Transducer 12 can then convert any received electrical power to mechanical power which in turn acts upon mechanical disturbance 14.

The power for sensor 40 and control electronics 308 is supplied by the energy accumulated in storage element 20, which has been extracted from disturbance 14. The cyclic peak power needed by transducer 12 is supplied by resonant circuit 302. Energy accumulated in storage element 20 can also or alternatively be used to power an external application 48 or the power extraction circuitry itself for vibration suppression.

Rather than employ a storage element, extracted power can be used directly to power external application 48.

Figure 15:
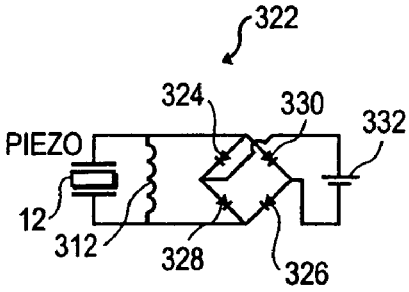
FIG. 15 is a circuit diagram of an alternative embodiment of a resonant rectifier power extraction system.

An alternative resonant circuit 322 is shown in FIG. 15. Circuit 322 includes an inductor 312 and four diodes 324, 326, 328 and 330 connected as a full wave bridge. Power extracted from transducer 12 is stored in storage element 332.

The current flow through circuit 322 can be described in four phases:

Phase I: As the transducer voltage increases from zero, no current flows through diodes 324, 326, 328 and 330 while the transducer voltage is less than the voltage on storage element 332.

Phase II: When the transducer voltage grows larger than the voltage on storage element 332, diodes 324, 326 become forward biased, and current flows through diodes 324, 326 and into storage element 332.

Phase III: As the transducer voltage drops, all diodes are reverse-biased and the system operates as an open circuit.

Phase IV: When the transducer voltage goes negative and has a magnitude greater than the voltage on storage element 332, diodes 328 and 330 become forward biased, and current flows through diodes 328 and 330 into storage element 332. As the transducer voltage begins to increase, all diodes again become reverse biased and phase I repeats.

Figure 16:
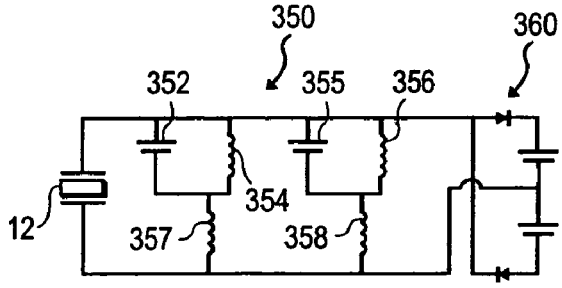
FIG. 16 is a circuit diagram of an additional alternative embodiment of a resonant rectifier power extraction system.

Referring to FIG. 16, a more sophisticated resonant circuit 350 includes two capacitor and inductor pairs 352, 354 and 355, 356, respectively, and two resonance inductors 357, 358. Each capacitor, inductor pair is tuned to a different frequency of interest. Thus, circuit 350 has multiple resonances which can be tuned to or near multiple disturbance frequencies or multiple resonances of the mechanical system. Additional capacitors and inductors may be incorporated to increase the number of resonances in circuit 350. Broadband behavior can be attained by placing a resistance in series or parallel with the inductors. FIG. 16 shows resonant circuit 350 connected to a voltage doubling rectifier 360, which operates as in FIG. 12B.

The different resonant circuits of FIGS. 12B and 16 can be attached to different rectifier circuits, such as a full bridge rectifier or an N-stage parallel-fed rectifier.

A passive voltage doubling rectifier circuit 410 for extracting energy from transducer 12 is shown in FIG. 17. Circuit 410 includes diodes 414, 416. Power extracted from transducer 12 is stored in storage elements 418, 420.

The current flow through circuit 410 can be described in four phases:

Phase I: As the transducer voltage increases from zero, no current flows through diodes 414, 416 while the transducer voltage is less than the voltage on storage element 418.

Phase II: When the transducer voltage grows larger than the voltage on storage element 418, diode 414 becomes forward biased, and current flows through diode 414 into storage element 418.

Phase III: As the transducer voltage drops, diodes 414, 416 are reverse-biased and the circuit operates as an open circuit.

Phase IV: When the transducer voltage 4 goes negative and has a magnitude greater than the voltage on storage element 420, diode 416 becomes forward biased, and current flows through diode 416 into storage element 420. As the transducer voltage begins to increase, diodes 414, 416 are reverse-biased and phase I repeats.

Referring to FIGS. 18A–18F, an example of the power extracted from transducer 12 in circuit 410 is graphically represented where the open circuit amplitude of the voltage across transducer 12 would have been 10 volts. FIG. 18A shows the voltage across transducer 12 as a function of time. The peak amplitude of the voltage is about 5 volts. FIG. 18B shows the current waveform on transducer 12, and FIG. 18C the charge waveform.

The power to and from transducer 12, FIG. 18D, has a peak value of about $5\times10^{-4}$ Watts. The extracted power and energy are shown in FIGS. 18E and 18F. Over a period of 0.06 seconds, approximately $0.75\times10^{-5}$ Joules of energy are extracted.

The voltage across storage elements 418, 420 is tuned to optimize power extraction. The voltage across storage elements 418, 420 is optimally about half the voltage which Would appear across an open circuit transducer undergoing the same mechanical disturbance.

Figure 19:
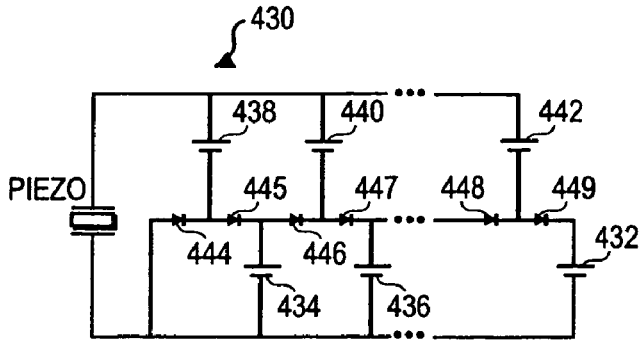
FIG. 19 is a circuit diagram of an alternative embodiment of a passive rectifier power extraction system.

Referring to FIG. 19, in a passive, N-stage parallel fed voltage rectifier 430 the voltage of storage element 432 is N times the amplitude of the voltage of disturbance 14. Capacitors 434, 436 act as energy storage elements with the voltage in each stage being higher than the voltage in the previous stage. Capacitors 438, 440 and 442 act as pumps transferring charge from each stage to the next, through diodes 444–449. A resonant circuit as described above can be incorporated into rectifier 430.

Figure 20A:
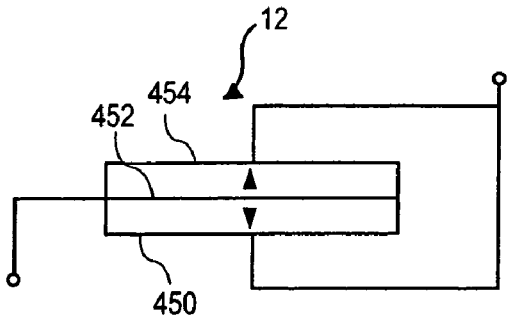
FIGS. 20A–20B illustrate partitioning of a transducer.
Figure 20B:
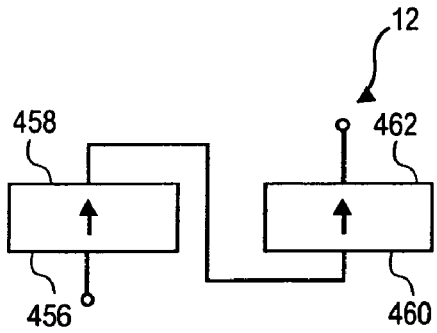

A transducer may be partitioned, and different electrode or coil configurations, that is, the electrical connections to transducer 12, may be used to optimize electric characteristics. Such configurations are shown for piezoelectric transducers in FIGS. 20A and 20B where for the same volume of material and the same external disturbance, different electrode configurations provide tradeoffs between the voltage and current output of transducer 12. For example, in FIG. 20A transducer 12 is segmented longitudinally and connected electrically in parallel with electrodes 450, 452, and 454, providing for higher current and lower voltage. In FIG. 20B, the transducer area is segmented and connected electrically in series with electrodes 456, 458, 460, and 462, providing for higher voltage and lower current.

Figure 21:
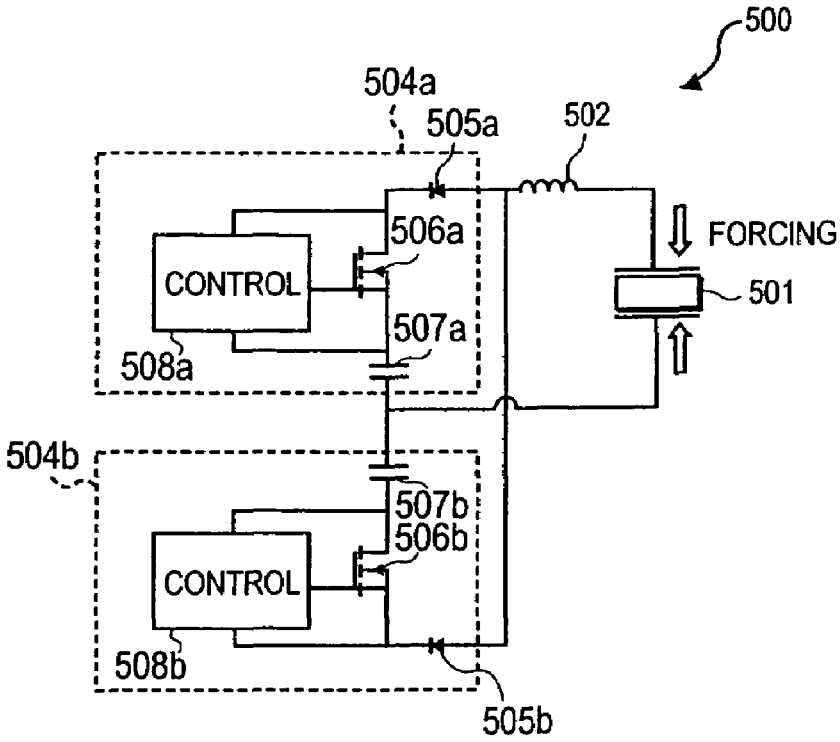
FIG. 21 is a circuit diagram of an alternative embodiment of a power extraction system.

Referring to FIG. 21, a circuit 500 for extracting electrical power from a transducer 501 includes an inductor 502, and two symmetric sub-circuits 504*a*, 1504*b*. Each sub-circuit 504*a*, 504*b* has a diode 505*a*, 505*b*, a switching element 506*a*, 506*b*, a storage element 507*a*, 507*b*, and control circuitry 508*a*, 508*b*, respectively. The switching element 506*a*, 506*b*, is, for example, a MOSFET, bipolar transistor, IGBT, or SCR. The storage element 507*a*, 507*b* is, for example, a capacitor, a rechargeable battery or combination thereof.

Circuit 500 is preferably used to dampen vibration of the racket for ball sports, to which transducer 501 is coupled.

Figure 22A:
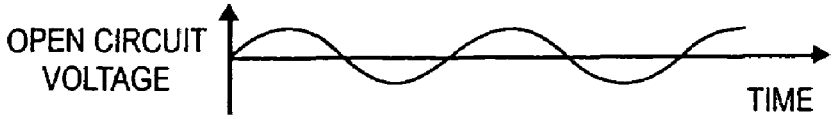
FIGS. 22A–22C are voltage and current versus time graphs.
Figure 22B:
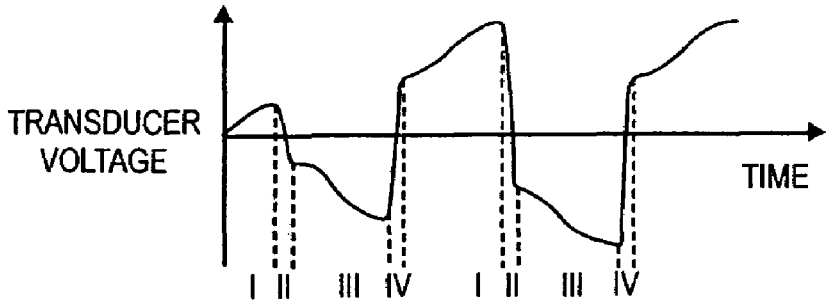
Figure 22C:
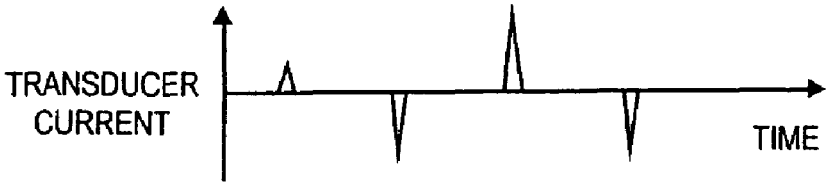

The operation of circuit 500 is described with reference to FIGS. 22A–22C. For reference, FIG. 22A shows the voltage on transducer 501 as a result of an oscillating external disturbance, in the absence of circuit 500. The operation of circuit 500 can be divided into four phases. FIGS. 22B and 22C are graphical representations of the four phases, FIG. 22B showing the voltage across transducer 501 as a function of time, and FIG. 22C showing the current through transducer 501 as a function of time.

Phase I: As the voltage on transducer 501 increases in response to the oscillatory disturbance, switches 506*a* and 506*b* are both in the off position, and no current flows through the switches.

Phase II: After the voltage on transducer 501 peaks, control circuit 508*a* turns on switch 506*a*. Current from transducer 501 flows via the inductor 502, the diode 505*a*, and the switch 506*a* to the energy storage element 507*a*.

Phase IIa: While switch 506*a* is on, the amplitude of the current from transducer 501 increases, storing energy in inductor 502 and storage element 507*a*. In the process, the voltage across transducer 501 decreases and the voltage across storage element 507*a* increases. Current continues to increase from transducer 501 until the voltage across inductor 502 reaches zero.

Phase IIb: As the current from transducer 501 begins to decrease, the energy stored in inductor 502 is released, forcing the voltage across transducer 501 to drop below zero. This continues until the energy in inductor 502 is depleted, at which point the voltage across transducer 501 approaches the negative of the value it had prior to the beginning of phase II.

Phase III: With both switches 506*a*, 506*b* off for the next half cycle, the voltage on transducer 501 continues to decrease in response to the oscillatory disturbance.

Phase IV: After the voltage on transducer 501 reaches a minimum, the symmetric portion 504*b* of the circuit is activated. The control circuit 508*b* turns on switch 506*b*. Current from transducer 501 flows via the inductor 502, the diode 505*b*, and the switch 506*b* to the energy storage element 507*b*.

Phase IVa: While the switch is on, the amplitude of the current from transducer 501 increases, storing energy in inductor 502 and storage element 507*b*. In the process, the voltage across transducer 501 decreases and the voltage across storage element 507*b* increases. Current from transducer 501 continues to increase until the voltage across inductor 502 reaches zero.

Phase IVb: As the current from transducer 501 begins to decrease, the energy stored in inductor 502 is released, forcing the voltage across transducer 501 to drop below zero. This continues until the energy in inductor 502 is depleted, at which point the voltage across transducer 501 approaches the negative of the value it had prior to the beginning of phase IV.

As the four phases repeat, the magnitude of the voltage across transducer 501 increases. The voltage can be many times higher than the voltage which would have been measured across transducer 501 in the absence of circuit 500. As a result, more energy is extracted from transducer 501 during phases II and IV.

Figure 33:
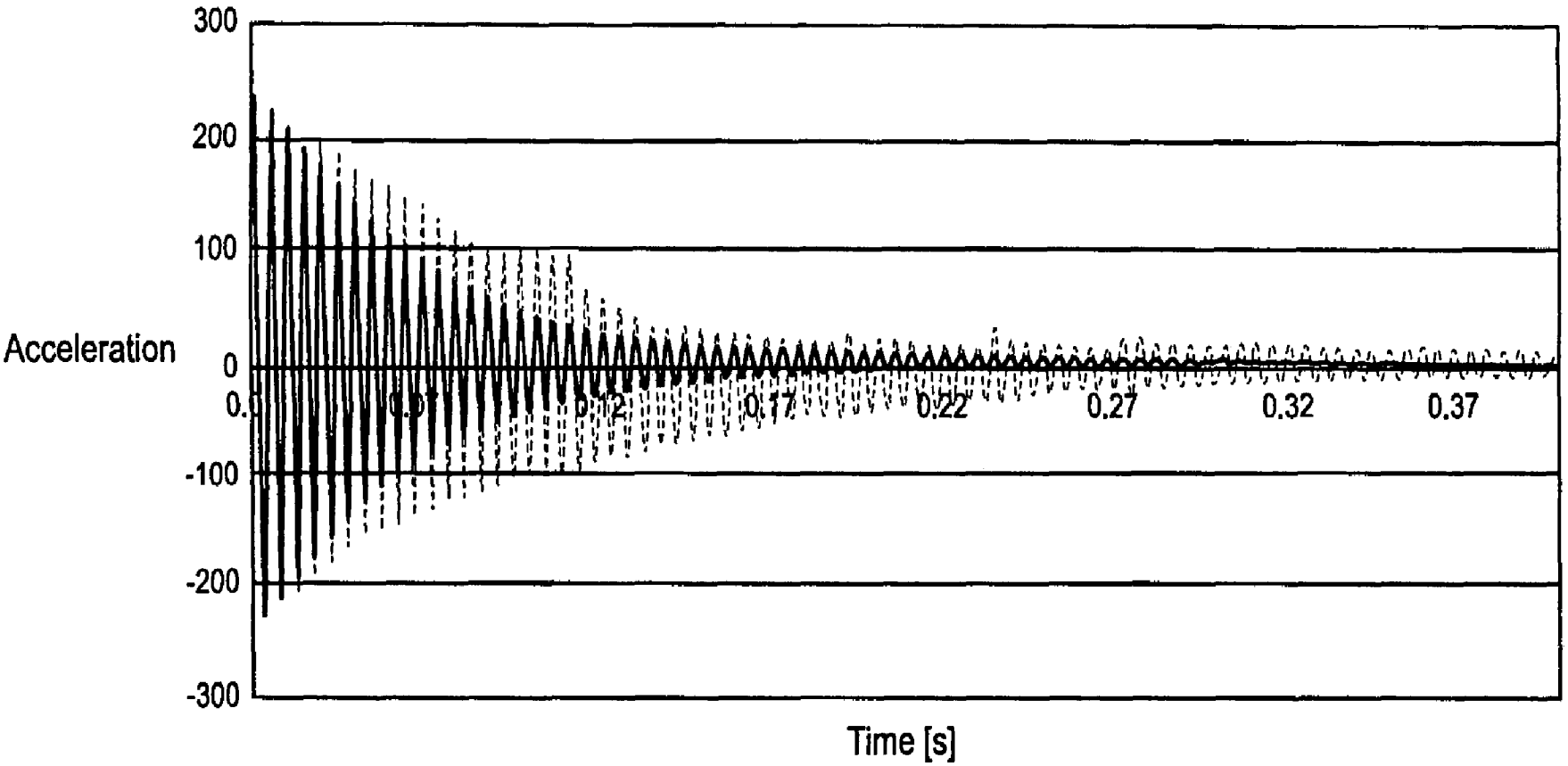
FIG. 33 is a diagram showing a damping characteristic of the racket of the present invention which an without the electrical circuit.

The gray curve shown in FIG. 33 represents the oscillation characteristics of the racket 600 of the present invention, wherein no electrical circuit is connected to the transducers. In order to dampen vibration of the racket, preferably the circuit 500 as shown in FIG. 21 is connected with the transducer. The circuit 500 comprises two energy storage elements 507*a* and 507*b* which are provided for storing energy extracted from the transducer during vibration of the racket. As soon as the racket vibrates, the transducer transduces the mechanical disturbance applied thereto into a voltage signal. During phases II and IV, this Voltage signal is used to store electrical energy in the energy storage elements 507*a* and 507*b*, respectively. This stored electrical energy is then used during phases III and I (see FIG. 22B) to actively dampen the racket in that the electrical energy is supplied back to the transducer. The timing of the switches 506*a* and 506*b* is controlled such that the voltage thus supplied to the transducer causes the transducer to transduce it into mechanical energy which acts against the vibrational movement of the racket and hence dampens the vibration. It is apparent from a comparison of FIGS. 22A and 22B that the voltage applied to the transducer by circuit 500 between two subsequent peaks of vibration (i.e., the maxima of the curve of FIG. 22A) does not change its polarity. Hence, the applied voltage applies a force on the racket that acts against the direction of the movement of the racket from one peak to the next peak (e.g. phase III). Subsequently, the circuit forces the voltage across the transducer to change polarity. The opposite voltage is applied to the transducer during back-movement of the racket (phase I) thus applying a force that again acts against the movement of the racket and dampens the vibration of the racket The black line in the diagram of FIG. 33 illustrates the oscillation characteristics of the racket 600 of the present invention with the self-powered electrical circuit.

Figure 23:
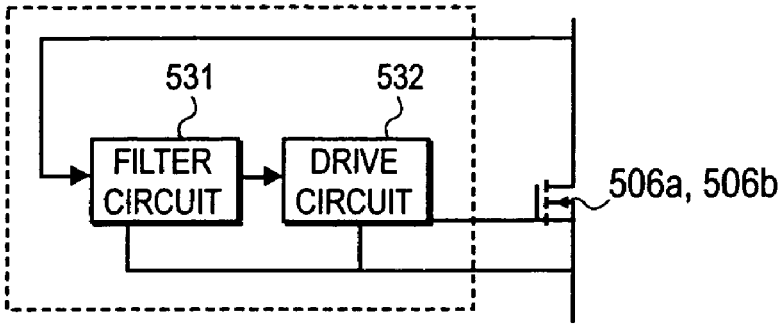
FIG. 23 is a block diagram of a control circuit of the power extraction system of FIG. 21.

Referring to FIG. 23, the control circuitry 508*a*, 508*b* includes a filter circuit 531 for processing the voltage across switch 506*a*, 506*b*, respectively, and a switch drive circuit 532. In this embodiment, the control circuit is powered from an external voltage source, not shown, such as a battery or power supply. The filter circuit 531 differentiates the signal and turns the switch on when the voltage across the switch begins to decrease. In addition, filter circuit 531 can include components for noise rejection and for turning the switch on if the voltage across the switch becomes greater than a pre-specified threshold. Filter circuit 531 can also include resonant elements for responding to specific modes of the disturbance.

Figure 24:
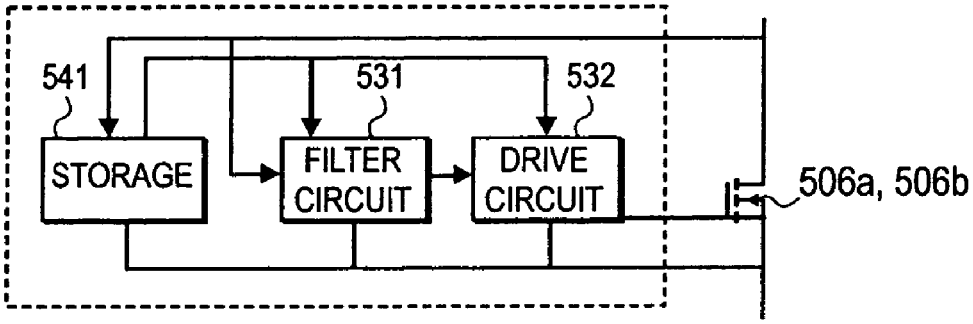
FIG. 24 is a block diagram of a self-powered control circuit.

Referring to FIG. 24, in an alternative embodiment, the control circuit includes a storage element 541 which is charged by current from transducer 501 Storage. element 541 is then used to power filter circuit 531 and switch drive circuit 532. This embodiment is self-powered in the sense that there is no need for an external power supply.

Figure 25:
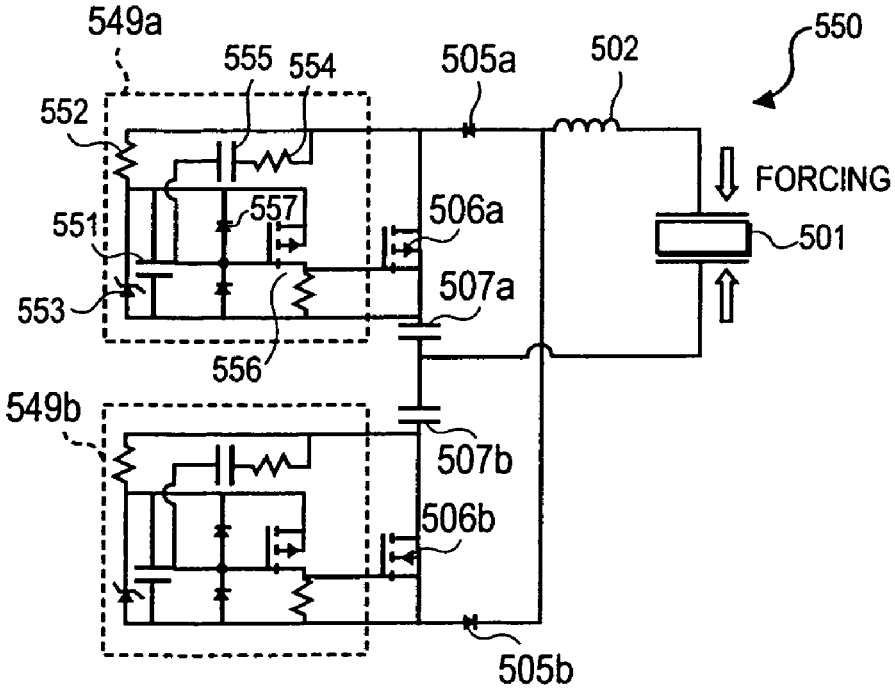
FIG. 25 is a circuit diagram of a power extraction system employing a self-powered control circuit.

Referring to FIG. 25, a self-powered circuit 550 for extracting electrical power from transducer 501 requires no external power for operating control circuits 549*a*, 549*b* and transducer 501. A capacitor 551, which is charged up through a resistor 552 and/or through resistor 554, capacitor 555 and diode 557 during phase I of the circuits operation (i.e. while the voltage across the transducer is increasing), acts as the storage element 541. A Zener diode 553 prevents the voltage of capacitor 551 from exceeding desired limits. When the voltage across transducer 501 begins to decrease, a filter (resistor 554 and capacitor 555) turns on a p-channel MOSFET 556. MOSFET 556 then turns on switch 506*a*, using the energy stored in capacitor 551 to power the gate of MOSFET 556. In the process, capacitor 551 is discharged, causing switch 506*a* to turn off after a desired interval. The same process is then repeated in the second half of the circuit.

Figure 26:
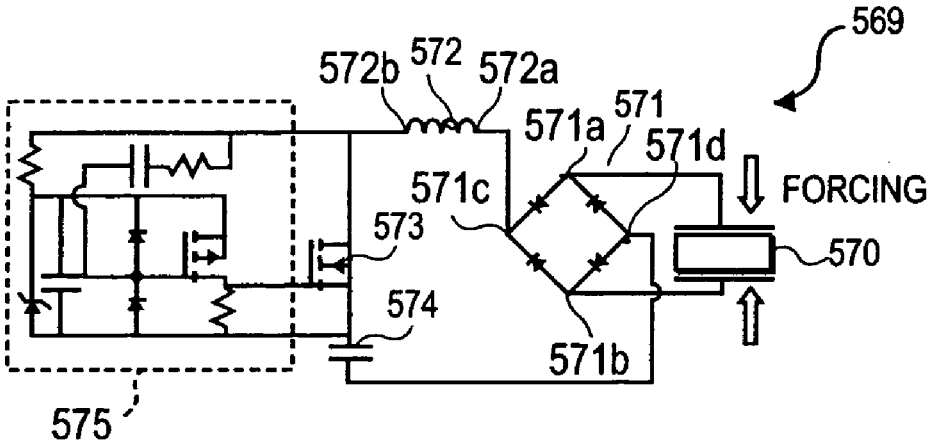
FIG. 26 is a circuit diagram of an alternative embodiment of a power extraction system.

Referring to FIG. 26, a circuit 569 for extracting electrical power from a transducer 570 includes a rectifier 571, an inductor 572, a switching element 573, a storage element 574, and control circuitry 575. The switching element 573 is, for example, a MOSFET, bipolar transistor, IGBT, or SCR. The storage element 574 is, for example, a capacitor, a rechargeable battery or combination thereof. The control circuit 575 corresponds to self-powered control circuitry 549*a* described, above with reference to FIG. 25. Rectifier 571 has first and second input terminals 571*a*, 571*b*, and first and second output terminals 571*c*, 571*d*. First and second input terminals 571*a*, 571*b* are connected across first and second terminals 570*a*, 570*b* of transducer 570. Inductor 572 includes first and second terminals 572*a*, 572*b*. First terminal 572*a* of inductor 572 is connected to first output terminal 571*c* of rectifier 571. Switching element 573 is connected to second terminal 572*b* of inductor 572 and second output terminal 571*d* of rectifier 571.

Figure 27:
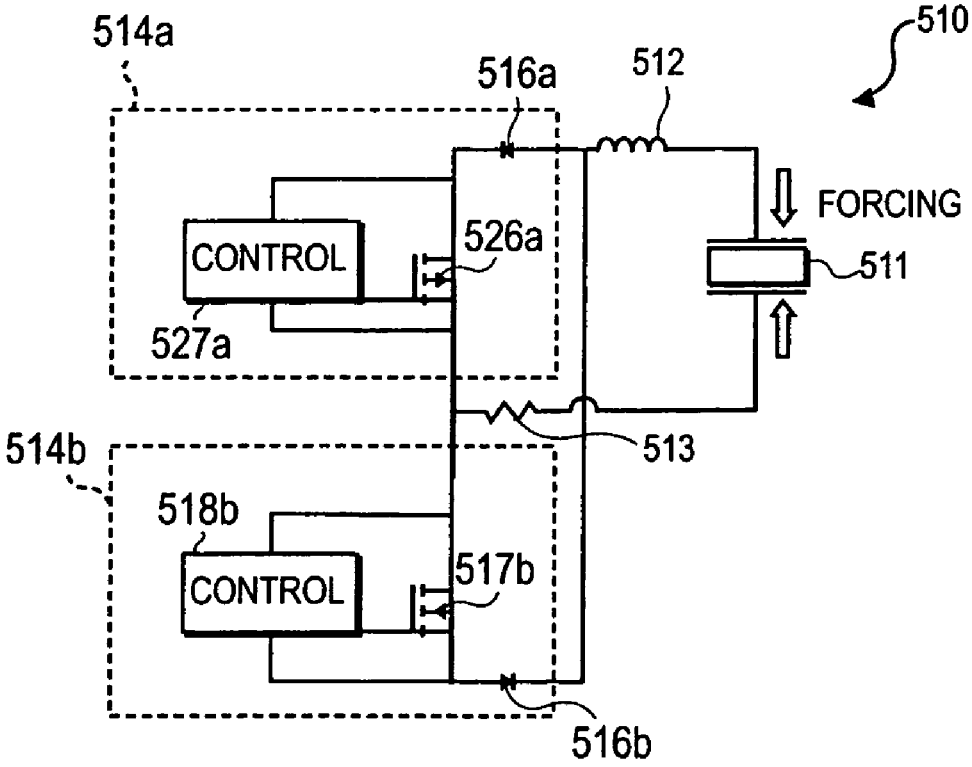
FIG. 27 is a circuit diagram of a power damping system.

Referring to FIG. 27, a circuit 510 for dampening vibration of a racket to which a transducer 511 is attached includes an energy dissipation component 513, such as a resistor, in the circuit. Circuit 10 also includes an inductor 512 and two symmetric sub-circuits 514*a*, 514*b*. Each sub-circuit 514*a*, 514*b* includes a diode 516*a*, 516*b*, a switching element 517*a*, 517*b*, and control circuitry 518*a*, 518*b*, respectively. The switching element 517*a*, 517*b* is, for example, a MOSFET, bipolar transistor, IGBT, or SCR. The dissipation element 513 can be eliminated if the inherent energy loss in the remaining circuit components provide sufficient energy dissipation.

Figure 28:
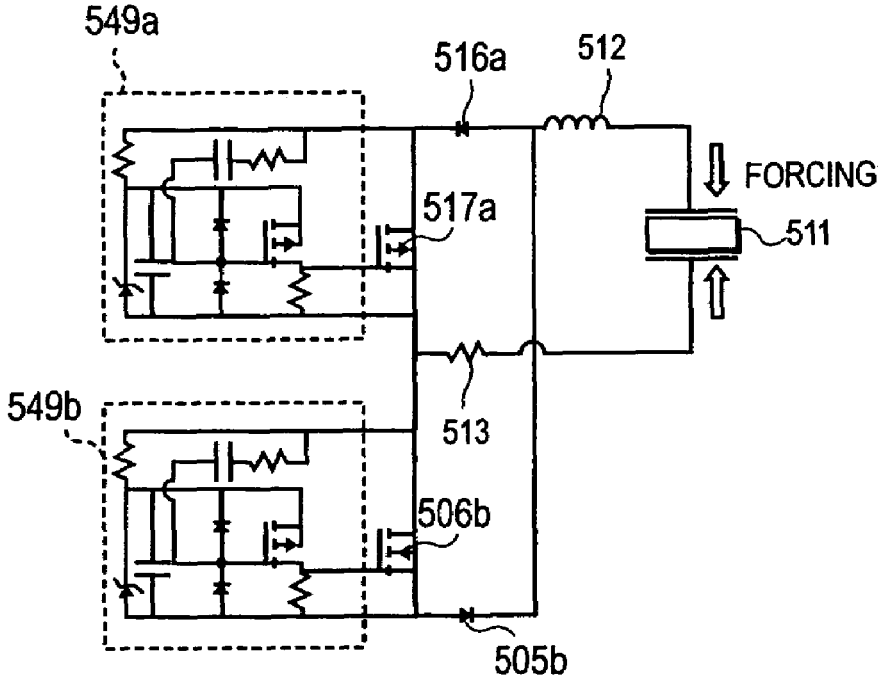
FIG. 28 is a circuit diagram of a self-powered power damping system.
Figure 29:
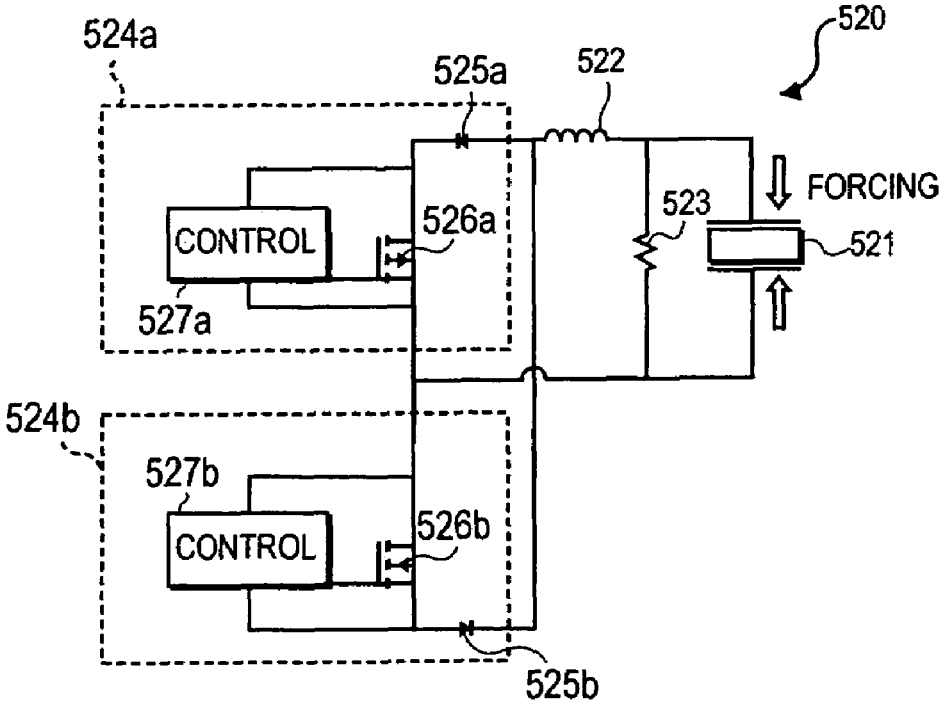
FIG. 29 is a circuit diagram of an alternative embodiment of a power damping system.

FIG. 28 shows an implementation of the circuit of FIG. 27 incorporating the self-powered control circuitry 549*a*, 549*b* described above with reference to FIG. 26. Referring to FIG. 29, a circuit 520 for dampening vibration of a racket to which a transducer 521 is attached includes an inductor 522, an energy dissipation component 523, such as a resistor, and two symmetric sub-circuits 1524*a*, 524*b*. Each sub-circuit 524*a*, 524*b* includes a diode 525*a*, 525*b*, a switching element 526*a*, 526*b*, and control circuitry 527*a*, 527*b*, respectively. The switching element 516*a*, 526*b* is, for example, a MOSFET, bipolar transistor, IGBT, or SCR. The dissipation component 523 can be eliminated if the inherent energy loss in the remaining circuit components provide sufficient energy dissipation. Control circuitry 527*a*, 527*b* can be as described above with reference to FIG. 28.

The placement of the dissipation component in FIGS. 27 and 29 effects the size of the circuit components selected to provide the desired dissipation. The particular placement depends upon the amplitude and frequency of the vibrations of the mechanical disturbance and the capacitance of the transducer.

Figure 30:
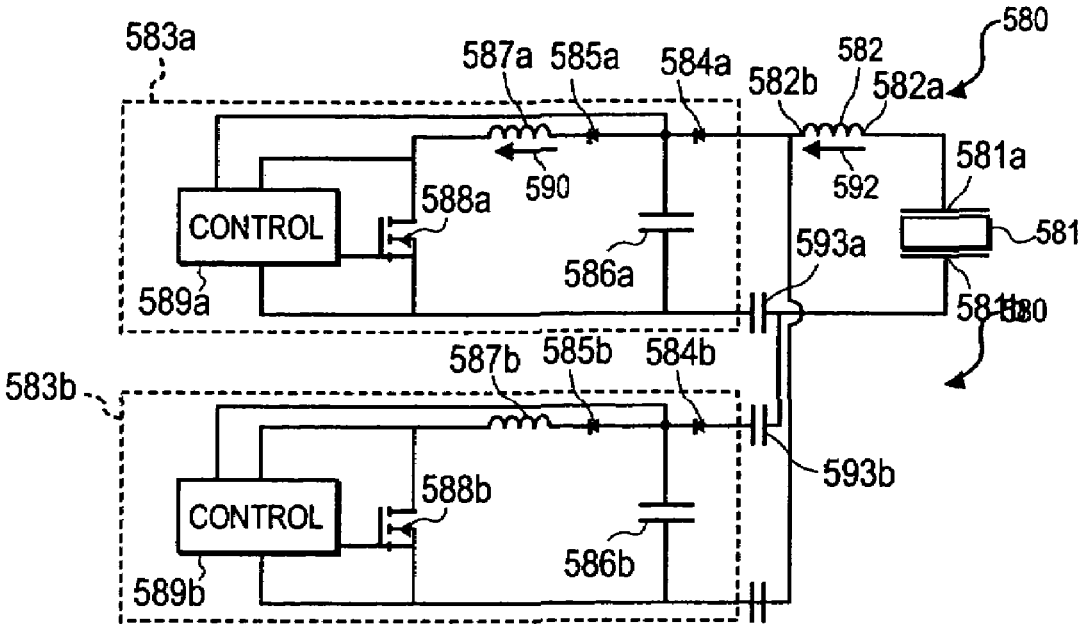
FIG. 30 is a circuit diagram of an additional alternative embodiment of a power extraction system.

Referring to FIG. 30, a circuit 580 for extracting electrical power from a transducer 581 includes an inductor 582 and two symmetric subcircuits 583*a*, 583*b*. Each subcircuit 583*a*, 583*b* includes a pair of diodes 584*a* and 585*a*, 584*b* and 585*b*, a capacitor 586*a*, 586*b*, an inductor 587*a*, 587*b*, a switching element 588*a*, 588*b*, control circuitry 589*a*, 589*b*, and storage, element 593*a*, 593*b*, respectively. The switching element 588*a*, 588*b* is, for example, a MOSFET, bipolar transistor, IGBT, or SCR. Inductor 582 has a first terminal 582*a* connected to a first terminal 581*a* of transducer 581, and a second terminal 582*b* connected to subcircuit 583*a*. Subcircuit 583*a* is also connected to a second terminal 581*b* of transducer 581. Subcircuit 583*b* is also connected to second terminal 582*b* of inductor 582 and second terminal 581*b* of transducer 581. The storage elements 593*a*, 593*b* have relatively large capacitance values and therefore their voltage is small relative to the transducer voltage or the voltage across capacitors 586*a*, 586*b*. Diodes 584*a*, 584*b*, 585*a*, 585*b* ensure that power flows into storage elements 593*a*, 593.

Circuit 580 can also be used to dampen vibration of a racket to which transducer 531 is coupled. For this purpose, the storage elements 593*a*, 593*b* can be replaced by dissipation components, for example, resistors, as in FIG. 25. Alternatively, a dissipation component can be connected in parallel with transducer 581, as in FIG. 29. The dissipation component can be eliminated if the inherent energy loss in the remaining circuit components provide sufficient energy dissipation.

Figure 31A:
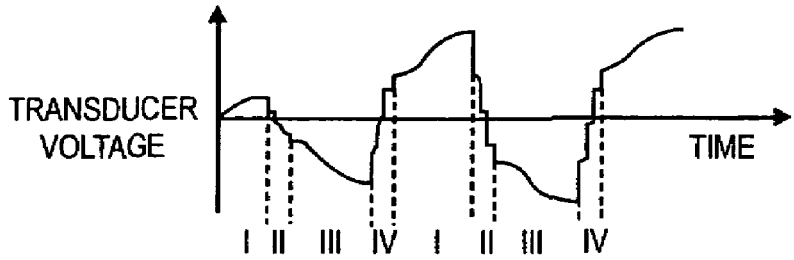
FIGS. 31A–31C are voltage versus time graphs.
Figure 31B:
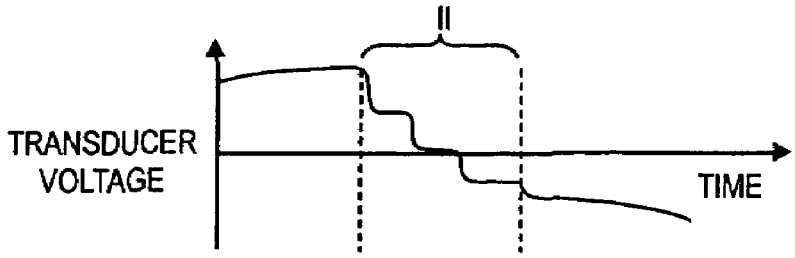
Figure 31C:
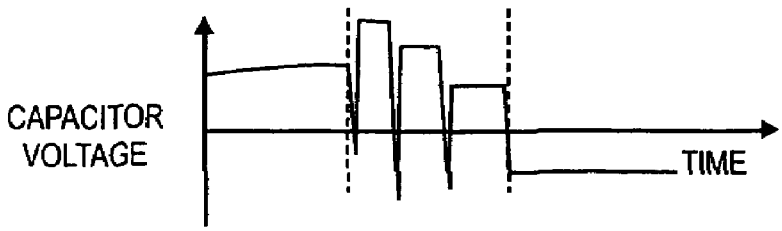

The operation of circuit 580 is described with reference to FIGS. 31A–31C. FIG. 31A shows the voltage across transducer 581 as a function of time and can be compared with the waveform of FIG. 22B. The additional inductors 587*a*, 587*b* and capacitors 586*a*, 586*b* in each subcircuit, in combination with control circuits 589*a*, 589*b*, described further below, cause multiple steps in the voltage during phase II and phase IV. FIGS. 31B and 31C show in more detail the voltage across transducer 581 and across capacitor 586*a* during phase II.

Phase I: As the voltage on transducer 581 increases in response to the oscillatory disturbance, switches 588*a*, 588*b* are both in the off position, and no current flows through the switches. The voltage across capacitor 586*a* is effectively equal to the voltage across transducer 581.

Phase II: After the voltage on transducer 586*a* peaks, control circuit 589*a* turns on switch 588*a*. Current 590 from capacitor 586*a* flows via diode 585*a* and inductor 587*a* through switch 588*a*. Thus the voltage across capacitor 586*a* drops rapidly. As the voltage across capacitor 586*a* drops below the voltage across transducer 581, current 592 begins to flow from transducer 581 through inductor 582 and diode 584*a* to capacitor 586*a*. As current 592 becomes larger than current 590, the voltage across capacitor 586*a* stops decreasing and begins to increase. Switch 588*a* is turned off as soon as the voltage across capacitor 586*a* begins to increase. The current from transducer 581 then causes the voltage across capacitor 586*a* to increase rapidly to a value possibly larger than its value prior to the beginning of phase II. During this process, the voltage across transducer 581 is reduced to a fraction of its value prior to phase II. After a short delay, the control circuit turns on switch 588*a* again, and the process is repeated several times during phase II. Thus the voltage across transducer 581 decreases in a number of steps.

Phase III: With both switches 588*a*, 588*b* off for the next half cycle, the voltage on transducer 581 continues to decrease in response to the oscillatory disturbance. The voltage across capacitor 586*b* is effectively equal to the voltage across transducer 581.

Phase IV: After the voltage on capacitor 586*b* reaches a peak, the process of phase II repeats for subcircuit 583*b*.

As the four phases repeat, the magnitude of the voltage across transducer 581 increases. The multiple switching events that occur during phases II and IV, in effect slow the transition in the transducer voltage that occurs during these phases. As a result, less high frequency noise is caused in the racket to which transducer 581 is coupled in the process of damping the low frequency vibration as compared to the circuit of FIG. 21.

Figure 32:
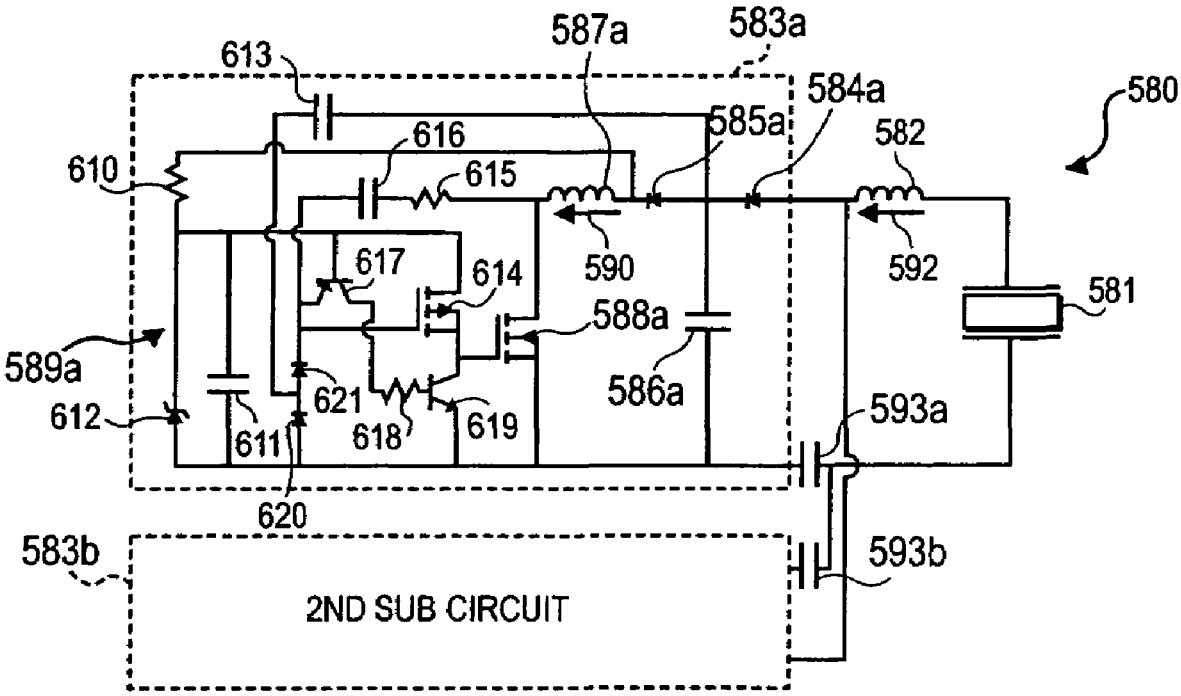
FIG. 32 is a circuit diagram of a control circuit of the circuit of FIG. 30.

Referring to FIG. 32, an embodiment of the control circuit 589*a* is self-powered, requiring no external power. A capacitor 711 is charged through resistor 710 and/or through resistor 715, capacitor 716, diode 721, and transistor 717, during phase I of the circuit's operation (i.e., while the voltage across the transducer is increasing). A Zener diode 712 prevents the voltage of capacitor 711 from exceeding desired limits. When the voltage across capacitor 586*a* begins to decrease, a high-pass filter (resistor 715 and capacitor 716) turns on a p-channel MOSFET 714. MOSFET 714 then turns on switch 588*a*, using the energy from capacitor 711 to power the gate of switch 588*a*. Current 590 flowing through inductor 587*a* and switch 588*a* causes the voltage across capacitor 586*a* to decrease rapidly. As the voltage across capacitor 586*a* decreases, current 592 begins to flow from transducer 581 through inductor 582 and diode 584*a* to capacitor 586*a*. As current 592 becomes larger than current 590, the voltage across capacitor 586*a* stops decreasing and begins to increase, at which point, a high-pass filter (capacitor 713) turns off MOSFET 714 through diode 721, and turns on transistor 717 which causes transistor 719 to turn on. As a result, switch 588*a* is turned off. The process is repeated several times, causing the voltage across transducer 581 to decrease in a number of steps, as shown in FIG. 31.

FIG. 33 shows a damping or oscillation diagram in which acceleration is plotted via time. More particularly, this diagram shows an oscillation characteristics of the racket 600 of the present invention with and without the electrical circuit connected to the transducers. The gray curve shown in FIG. 33 represents the oscillation characteristics of the racket 600 of the present invention, wherein no electrical circuit is connected to the transducers. The black line in the diagram illustrates the oscillation characteristics of the racket 600 of the present invention with the self-powered electrical circuit. As can be seen from this diagram, the oscillation characteristics of the racket can be substantially influenced with the electrical circuit connected to the transducers, and the time for the oscillation to reach its half amplitude is decreased, e.g., by one third to two thirds, preferably about 50%, whereby substantially improved handling characteristics can be obtained.

I claim:

1. A racket comprising:

a racket frame comprising a racket handle portion orientated along a longitudinal axis of the racket, a racket head portion allowing for the attachment thereto of generally longitudinally directed strings and generally laterally directed strings to form a string bed of the racket, and a racket throat area joining the handle portion with the head portion; and a self-powered piezoelectric damping system comprising two transducer elements laminated to the racket frame and a first circuit located within the racket handle portion and electrically connected to the transducer elements by way of a Y-shaped flex circuit, the first circuit including at least one storage element configured to store electrical power extracted from the two transducer elements;

wherein stored electrical power is transmitted back through the Y-shaped flex circuit to the transducers for conversion to mechanical power, the mechanical power being adapted to actively stiffen the racket;

wherein the transducer elements each have a size of about 8 $cm^2$ to about 16 $cm^2$; and wherein electrical power derived from mechanical deformation of the racket is supplied back to the transducer elements, the transducer elements being mounted in a region of the racket where maximum deformation occurs.

2. The racket of claim 1, wherein at least one of the two transducer elements is located at the racket throat area.

3. The racket of claim 1, wherein at least one of the transducer element is electrically connected to the first circuit.

4. The racket of claim 1, wherein at least one of the transducer element is located at the racket throat area and electrically connected to the first circuit.

5. The racket of claim 1, wherein the racket further includes a protective coating covering at least one of the transducer elements.

6. The racket of claim 1, wherein the circuit is affixed to an end cap of the racket and the end cap is affixed to the racket handle portion.

7. The racket according to claim 1, wherein the transducer elements include piezoelectric fibers.

8. A racket comprising:

a racket frame comprising a racket handle portion orientated along a longitudinal axis of the racket, a racket head portion allowing for the attachment thereto of generally longitudinally directed strings and generally laterally directed strings to form a string bed of the racket, and a racket throat area joining the handle portion with the head portion;

a self-powered piezoelectric damping system comprising two transducer elements laminated to the racket frame and at least one first circuit located within the racket handle portion and electrically connected to the transducer elements by way of a Y-shaped flex circuit; and at least one storage element configured to store electrical power extracted from the two transducer elements, wherein the racket handle portion includes a slot in the racket handle portion and the first circuit is affixed within the slot;

wherein stored electrical power is transmitted back through the Y-shaped flex circuit to the transducers for conversion to mechanical power, the mechanical power being adapted to actively stiffen the racket;

wherein the transducer elements each have a size of about 8 $cm^2$ to about 16 $cm^2$; and wherein electrical power derived from mechanical deformation of the racket is supplied back to the transducer elements, the transducer elements being mounted in a region of the racket where maximum deformation occurs.

9. The racket of claim 8, wherein the slot extends completely through the racket handle portion.

10. The racket of claim 8, wherein the slot is at least partially filled with a foam to fix the circuit within the slot.

11. The racket of claim 8, wherein the circuit includes a circuit board and the circuit board is affixed to the racket handle portion.

12. The racket according to claim 8, wherein the transducer elements include piezoelectric fibers.

13. The racket of claim 8, wherein the racket further includes a protective coating covering at least one of the transducer elements.

14. A racket comprising:

a racket frame comprising a racket handle portion orientated along a longitudinal axis of the racket, a racket head portion allowing for the attachment thereto of generally longitudinally directed strings and generally laterally directed strings to form a string bed of the racket, and a racket throat area joining the handle portion with the head portion;

a self-powered piezoelectric damping system comprising two transducer elements and at least one first circuit located within the racket handle portion and electrically connected to the transducer elements by way of a Y-shaped flex circuit; and a storage element configured to store electrical power extracted from the two transducer elements;

wherein electrical power derived from mechanical deformation of the racket is supplied back to the transducer elements, the transducer elements being mounted in a region of the racket where maximum deformation occurs;

wherein the first circuit is located within a slot in the racket handle portion and electrically connected to the Y-shaped flex circuit to enable transmission of electrical power from within the slot, back through the Y-shaped flex circuit, and to the transducers for conversion to mechanical power, the mechanical cower being adapted to actively stiffen the racket.

15. The racket of claim 14, wherein at least one of the two transducer elements is located at the racket throat area.

16. The racket of claim 14, wherein at least one of the transducer element is electrically connected to the first circuit.

17. The racket of claim 14, wherein at least one of the transducer element is located at the racket throat area and electrically connected to the first circuit.

18. The racket of claim 14, wherein the racket further includes a protective coating covering at least one of the transducer elements.

19. The racket of claim 14, wherein the circuit is affixed to an end cap of the racket and the end cap is affixed to the racket handle portion.

20. The racket according to claim 14, wherein the transducer elements include piezoelectric fibers.

* * * * *